United States Patent [19]

Rückert

[11] Patent Number: 4,886,307

[45] Date of Patent: Dec. 12, 1989

[54] LOCK, PARTICULARLY FOR TRUNK OR ENGINE COMPARTMENTS OF AUTOMOTIVE VEHICLES, DOORS OR THE LIKE

[75] Inventor: Edvard Rückert, Wülfrath, Fed. Rep. of Germany

[73] Assignee: Ewald Witte & Co., Velbert, Fed. Rep. of Germany

[21] Appl. No.: 94,463

[22] Filed: Sep. 4, 1987

[30] Foreign Application Priority Data

Apr. 1, 1987 [DE] Fed. Rep. of Germany ..... 3710844
May 21, 1987 [DE] Fed. Rep. of Germany ..... 3717013

[51] Int. Cl.[4] ..... E05B 51/02

[52] U.S. Cl. ..... 292/216; 292/201; 292/341.16; 292/DIG. 43; 292/DIG. 14

[58] Field of Search ..... 292/216, 201, 341.15–341.17, 292/DIG. 14, DIG. 23, DIG. 43, DIG. 61

[56] References Cited

U.S. PATENT DOCUMENTS

| | | | |
|---|---|---|---|
| 2,903,288 | 9/1959 | Joachim et al. | 292/341.16 |
| 2,916,319 | 12/1959 | Du Bois | 292/341.16 |
| 2,994,550 | 8/1961 | White | 292/341.16 |
| 3,047,326 | 7/1962 | Leslie et al. | 292/341.15 |
| 3,056,619 | 10/1962 | Fox et al. | 292/341.15 |
| 3,090,644 | 5/1963 | Fiala et al. | 292/201 X |
| 3,580,623 | 5/1971 | Peters | 292/201 |
| 3,596,484 | 8/1971 | Peters | 292/DIG. 43 X |
| 3,664,698 | 5/1972 | Stropkay | 292/216 X |
| 4,775,178 | 10/1988 | Boyko | 292/341.16 |

FOREIGN PATENT DOCUMENTS

| | | | |
|---|---|---|---|
| 184025 | 5/1963 | Sweden | 292/341.15 |

*Primary Examiner*—Gary L. Smith
*Assistant Examiner*—Eric K. Nicholson
*Attorney, Agent, or Firm*—Martin A. Farber

[57] ABSTRACT

A lock, particularly for trunk, hatch or engine compartments of automotive vehicles or doors or the like, having a mating closure part adapted to be arranged on a hinged part and to be brought into a closed position by means of an external force, comprising a force accumulator which forms the external force charging by displacement of the hinged part. One end of the force accumulator cooperates with a lock part which grips the mating closure part, the other end of the force accumulator acting upon a swingably mounted charging lever adapted to be released before the force accumulator is charged.

11 Claims, 20 Drawing Sheets

LOCK, PARTICULARLY FOR TRUNK OR ENGINE COMPARTMENTS OF AUTOMOTIVE VEHICLES, DOORS OR THE LIKE

FIELD AND BACKGROUND OF THE INVENTION

The present invention relates to a lock, particularly for trunk, hatch or engine compartments of automotive vehicles or doors or the like, with mating closure part adapted to be arranged on the hinged part or the like and which can be brought into closed position by means of an external force.

Automotive vehicles are known in which the mating closure part which is present on the hinged part of the engine compartment or trunk is pulled in electrically. Such constructions are dependent on a source of current, for instance a battery, and are expensive to produce from a technical standpoint.

It is an object of the invention to develop a simply manufactured lock of the introductory-mentioned type so that the pulling in of the hinged part which is provided with the mating closure part is obtained in the locking phase by mechanical means.

SUMMARY OF THE INVENTION

Accordingly the charging of a force accumulator which forms the external force is derived from a movement of displacement of the hinged part provided with a mating closure part.

As a result of this development, there is created a lock of the above-indicated type which is characterized by simple construction and is economical to manufacture. Furthermore, the lock operates reliably. The closing of the hinged part is not dependent on a source of current. Thus expensive electromotive aids can be dispensed with. As soon as the counterlock part comes into the region of the closure part upon the closing movement, the charged force accumulator can discharge and pull the hinged part into the closed position. This means that, for instance, the closing force acting on a trunk hood utilizes, on the one hand, the kinetic energy of the trunk hood itself and, on the other hand, the force of the force accumulator, which makes it possible to obtain dependably closed positions. The charging of the force accumulator takes place by the swinging of the hood so that the force accumulator is also charged before the closing thereof. In this way assurance is had that the closing is always supported by the force accumulator. Corresponding manipulations which impair the opening and closing process are therefore not necessary.

An embodiment in accordance with the invention comprises a closing auxiliary lever which grips over the mating closure part on its closing path and moves it in the closing direction, it being acted on by a force-accumulator spring which forms the force accumulator, the force-accumulator spring becoming charged by the opening stroke of the mating closure part. The charging of the force accumulator spring therefore takes place during the opening phase of the hood by the mating closure part which acts on the closing auxiliary lever. As soon as the mating closure part comes out of engagement with the auxiliary closure lever, the charging is completed.

In this connection it has been found advantageous for the mating closure part, which is caught by a fork latch and carries it along with it, to act on a release lever and move it into a position which releases the closing auxiliary lever for swinging by the force accumulator spring. The mating closure part is therefore itself the element which releases the release lever. Only when the mating closure part has swung the release lever sufficiently far, is the closing auxiliary lever released, and then leads to pulling-in which is supported by the force of the spring.

Another advantageous feature is that the auxiliary closure lever is mounted both for rotation and for longitudinal displacement against spring action and that the mating closure part comes against a control bevel of the auxiliary closure lever and moves the latter, held fast by the release lever, into a position of deflection from which it enters into a gripping over position with respect to the mating closure part. This means that in the open position of the lock, the control bevel of the auxiliary closure lever lies in the path of the mating closure part. Upon closing, the mating closure part acts on the control bevel and thereby forces a deflection displacement. As soon as the mating closure part has passed the control bevel, the spring load acting on the auxiliary closure lever leads to the mating closure part being gripped over. Upon further closure, the mating closure part acts on the release lever which now releases the force-spring-loaded auxiliary closure lever for swinging, bringing about the engaged position of the mating closure part.

Trouble-free closing is achieved by the displacement of the auxiliary closure lever, which is effected by the mating closure part, being directed to the arc of swing of the stop step of the release lever. This means that with a displacement of the auxiliary closure lever effected by the mating closure part, the engagement between the release lever and stop step of the auxiliary closure lever is intensified. Premature release can therefore not occur. Release is effected only when the mating closure part is gripped over by the auxiliary closure lever.

One embodiment is characterized by the fact that the mating closure part has an end portion of smaller cross section which strikes against the auxiliary closure lever and the release lever. The control bevel of the auxiliary closure lever and of the release lever are struck one after the other by this end portion.

It is possible for the portion of the mating closure part which acts on the auxiliary closure lever and the release lever to be separated in space from a portion of the mating closure part which controls the fork latch. In this way good adaptation to existing conditions of installation is obtained.

Locking of the closed position is obtained by a locking lever which is attached to the release lever by a tension spring and which, in its closed position, secures the fork latch by extending over it in hook shape. This tension spring performs a twofold function in that it also presses the release lever in the direction of engagement.

Advantages with respect to control are obtained if the release lever has a T-shaped contour and if the mating closure part strikes against the end surface of the bar of the T.

Another advantageous embodiment is that the release lever has a hook shape and forms the stop step for the auxiliary closure lever in the region of the inner surface of its hook, the end surface of the hook being acted on by the mating closure part.

One advantageous modification consists in that the mating closure part acts on the hook end surface with the interposition of the fork latch. Here also assurance is had that only after sufficiently wide engagement of the mating closure part in the lock and sufficient turning of the fork latch, is the release lever released, so that the auxiliary closure lever, supported by spring force, can effect the engagement of the mating closure part.

The force of the force accumulator which effects the pulling of the hood into the interlock position can be increased in the manner that the force accumulator cooperates on the one end with a closure part which captures the mating closure part and at the other end acts on a swingably mounted charging lever which is adapted to be released before a charging process of the force accumulator and which is connected via a free path with a swing lever pivoted on the hinged part (hood), the free path being eliminated in the release position of the charging lever. The charging of the force accumulator takes place now during the entire path of swing of the hood. As soon, as the charging lever is released, the free path between the swing lever and the charging lever is also eliminated, so that directly upon commencement of the opening of the hood, a displacement of the charging lever takes place together with the charging of the force accumulator. As a result of the large angle of swing of the hood in this case, a large force of the force accumulator can be obtained with a slight opening force, which has a favorable effect upon the pulling in of the hood for its closing. It has been found favorable from a construction standpoint for the loading lever to have two arms, one arm being connected to the swing lever via a pin/slot connection forming the free path and the other arm being connected to one arm of the force accumulator. The release of the charging lever with the force accumulator tensioned takes place in this case favorably via the release device which is actuatable manually or else also mechanically and preferably by an electric motor or electromagnetically. The locking member thereof, after the charging of the force accumulator, practically in the final phase of the movement of the hood, comes into blocking position with respect to the charging lever and sees to it that discharging can take place only in the final phase of the closing of the hinged part. In order that the blocking member can carry out the corresponding displacement independently of the closure part in order to obtain its blocking position, the blocking member is connected via a free path with a locking pawl which is associated with the closure part. This free path is, however, eliminated for direct release by the release device. As soon as the latter is actuated manually, the release of the charging lever and the swinging of the locking pawl into the position releasing the closure part take place simultaneously. If, on the other hand, the hinged part (hood) is closed and the closure part is swung positively by the mating closure part of the hood, then the closure part passes through a preliminary detent and a main detent. The preliminary detent position preferably coincides with the release of the force accumulator, so that the energy inherent in the force accumulator acts exclusively in the draw-in phase of the hood and brings the latter dependably into its closed position. The development of the closure part as a swingable fork latch makes it possible for the force accumulator to act on the fork-latch tail, effecting a favorable transfer of force. In order to provide assurance that the locking pawl always enters properly into the corresponding detent recesses in the fork latch, the locking pawl and the fork-latch tail are connected to each other by a tension spring. The hood can be moved over the preliminary detent position into the main detent position even if the force accumulator possibly fails. The action on the latch tail during the closing movement is effected with the interposition of the pull lever. It has been found advantageous for the pull lever to have a stop which can be released for the discharge of the force accumulator from a locking shoulder of a release member which can be released by the swinging movement of the fork latch. During the closing of the hood, therefore, the release member is swung via the fork latch, and the locking shoulder thereof accordingly moves away from the stop of the pull lever. The time of the release takes place in this connection on the path between preliminary detent and main detent of the fork latch so that in this way the pull lever can forcefully bring about the closing movement of the fork latch. After the unlocking of the hood, the shoulder of the release member again comes in front of the stop and blocks it, so that upon the following upward swing of the hood and the charging of the force accumulator taking place thereby the release member represents the abutment for the pull lever and thus for one end of the force accumulator.

Another embodiment is characterized by the fact that the force accumulator is charged only upon the closing of the hinged part (hood). The weight of the hinged part accordingly assists in the charging process. For this purpose, the force accumulator cooperates at one end with a closure part which captures the mating closure part and grips at the other end with swinging movement on a two-part charging lever. Upon the swinging of the hinged part into the closed position, the tensioning lever is positively swung and charges the force accumulator via the push lever which is pivoted to said tensioning lever. The discharge takes place in the manner that the mating closure part of the hinged part brings about the discharge position via the control of the closure part so that the pulling of the hood into the closed position then takes place supported by the force accumulator. The loading of the force accumulator upon the closing of the hinged part is assured in the manner that the push lever rests by means of its stop against the tensioning lever in the tensioning position. The push lever is preferably in this case spring-biased in the direction of its tensioning position. In order to translate the hood movement into a control of the tensioning lever, a force transmitting device acts in such a manner on the tensioning lever that upon the closing of the hood a swinging displacement of the tensioning lever takes place for the charging of the force accumulator. The force transmitting device is of such a nature that upon the opening of the hood, the tensioning lever is released for swinging into its spring-biased basic position. In this position the push lever then also assumes the tensioning position so that upon the closing of the hood, the charging of the force accumulator is assured. The development of the force transmitting device as a Bowden cable directly provides on inexpensive manufacture. Furthermore, the lock components can be provided in concealed arrangement. During the charging of the force accumulator, the end thereof which is opposite the push lever rests on the release member. The latter is continuously biased by a spring in the direction of the fork latch and developed as a rocker. In the final phase of the closing of the hinged part (hood), the fork latch tail acts on the run-on bevel of this release member which is developed as a one-arm rocker. By displacement thereof the pull lever comes out of the region of the locking shoulder of the release member so that the force accumulator can discharge over the pull lever and thereby turn the fork latch into the closed position. The opening of the lock can be effected by remote control. The pull rod thereof displaces the release lever, which in the release position acts on the push lever in such a manner that the pivot point between push lever and force accumulator comes into the past-dead-center position, which the subsequent opening of the hood permits together with a simultaneous turning of the push lever into its tensioning position. In this way the push lever is again ready to charge the force accumulator upon the closing of the hood. It is advantageous from a structural standpoint to develop the force accumulator as a gas pressure spring in both of the last-mentioned versions.

BRIEF DESCRIPTION OF THE DRAWINGS

With the above and other objects and advantages in view, the present invention will become more clearly understood in connection with the detailed description of preferred embodiments, when considered with the accompany drawings, of which.

DETAILED DESCRIPTION OF THE PREFERRED EMBODIMENT

Figure 1:
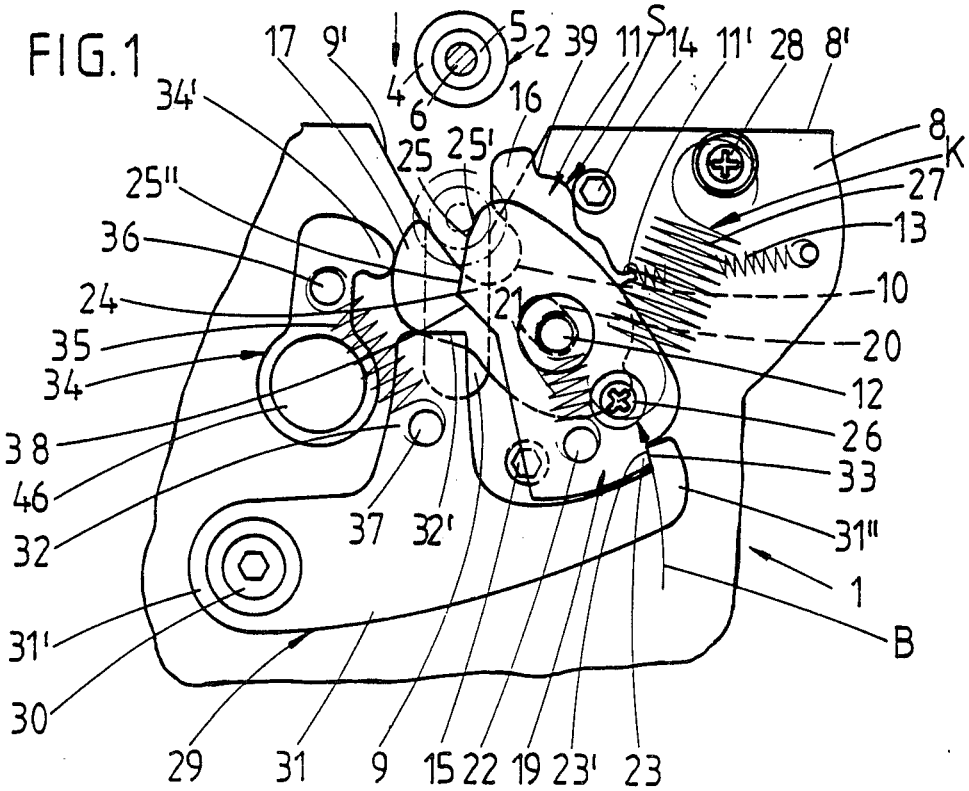
FIG. 1 shows a portion of the lock in accordance with the first embodiment in the region of its ward parts, in open position, with a corresponding mating closure part present on the trunk hood (not shown)
Figure 2:
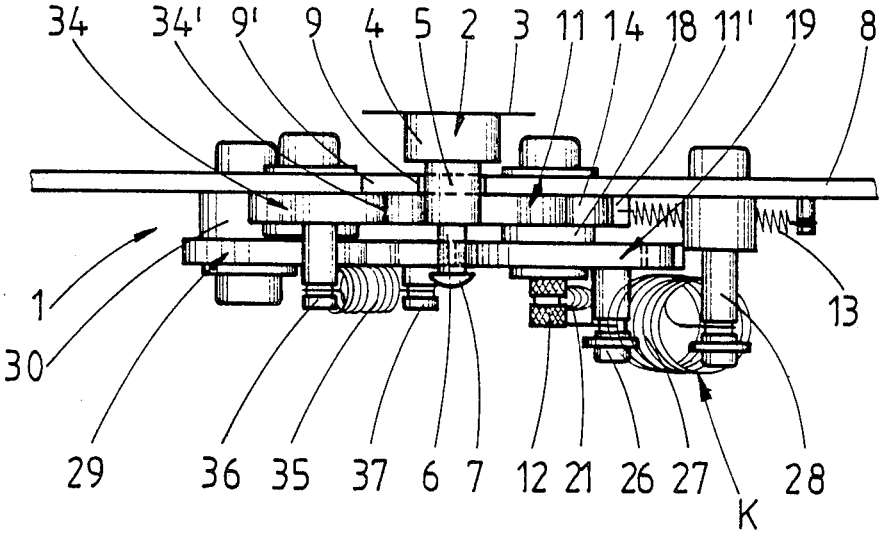
FIG. 2 is a top view of the lock of FIG. 1.

The mating closure part is developed in the shape of a pin and forms a portion 4 of larger cross section which is fastened to the trunk lid 3. Said portion passes into a central portion 5 of reduced cross section, adjoining which there is an end portion 6 of smaller cross section which is equipped on its end with a collar 7 of larger cross section.

The lock housing 1 contains a support plate 8. From the upper edge 8' thereof there extends a longitudinal slot 9 which is aligned with the closure path of the mating closure part 2 and extends on the side of the top edge into a funnel-shaped widening 9'. The slot 9 serves for guiding the central section 5 of the mating closure part 2.

Into the region of the slot 9 and its widening 9' there extends the end provided with a fork mouth 10, of a fork latch 11 which forms the closure part (lock part) S. For the mounting thereof there is provided a stud bolt 12. A tension spring 13 engages 6 a projection 11' of the fork latch 11. The tension spring 13 biases the fork latch 11 in clockwise direction. The fork latch is provided with a stop limitation by a stop 14 on the support-plate side. A second stop 15 is furthermore provided which limits the swinging of the fork latch in the other direction. The fork mouth 10 is flanked by two fork legs 16, 17. One fork leg 16 permits, in the open position of the lock, undisturbed entry of the middle portion 5 of the mating closure part into the fork mouth 10, while the other fork leg 17 lies in the region of movement of this middle portion.

On the stud bolt 12 there is furthermore mounted, with the interposition of a spacer disk 18, a double-arm auxiliary closure lever 19. The latter is seated both turnably and longitudinally displaceably on the stud bolt 12. For this purpose, the auxiliary closure lever 19 forms a slot 20 in its central region. The one end of a tension spring 21 is placed around the stud bolt 12. The other end engages behind the pin 22 of the one lever arm 23 of the auxiliary closure lever 19 and brings one end of the slot 20 against the stud bolt 12. The other lever arm 24 extends in an obtuse-angle arrangement with respect to the lever arm 23. The alignment of the slot 20 extends also in this direction. The lever arm 24 extends into the range of movement of the mating closure part and there forms a control bevel 25 which is composed of two sections 25' and 25" which adjoin each other with an obtuse angle.

On the lever arm 23 there is provided a pin-like projection 26 which is surrounded by one end of a force accumulator K which is developed as a tension spring 27. The other end of the tension spring 27 engages around a pin 28 which is attached in the region of the upper edge 8' of the support plate 8. In this way there is a swinging of the auxiliary closure lever 19 in counterclockwise direction. The swinging is limited by a release lever 29 which is mounted below the auxiliary closure lever 19 around a support-plate-side stud pin 30. The support point lies, in contradistinction to the stud bolt 12, on the other side of the slot 9. The release lever 29 is developed with a T-shaped contour and accordingly is composed of a T-beam 31 and a T-stem 32. The mounting place is located on one end 31 of the T-beam. The other end 31" together with a hook facing the auxiliary closure lever forms a stop step 33 in such a manner that a longitudinal displacement of the auxiliary closure lever 19 effected upon the closing is directed towards the swing arc B of this stop step.

The T-stem 32 extends into the path of movement of the mating closure part 2 and into the slot 9 of the support plate 8. It extends between the auxiliary closure lever 19 and a locking lever 34 mounted on the other side of the slot 9. Said locking lever is developed with a single arm; it is mounted about the pin 46 and forms a hook-like locking end 34' which, in the open position of the lock, strikes the facing end surface of the fork leg 17. The locking lever 34 is held in its contact position by a tension spring 35 which connects the locking lever 34 with the release lever 29 and thus urges the latter in counterclockwise direction and holds it in engagement with the auxiliary closure lever 19. The ends of the tension spring 35 engage behind a pin 36 of the locking lever 34 and a pin section 37 of the release lever 29. The pin section 37 is fixed in the region of the T-stem 32.

Figure 3:
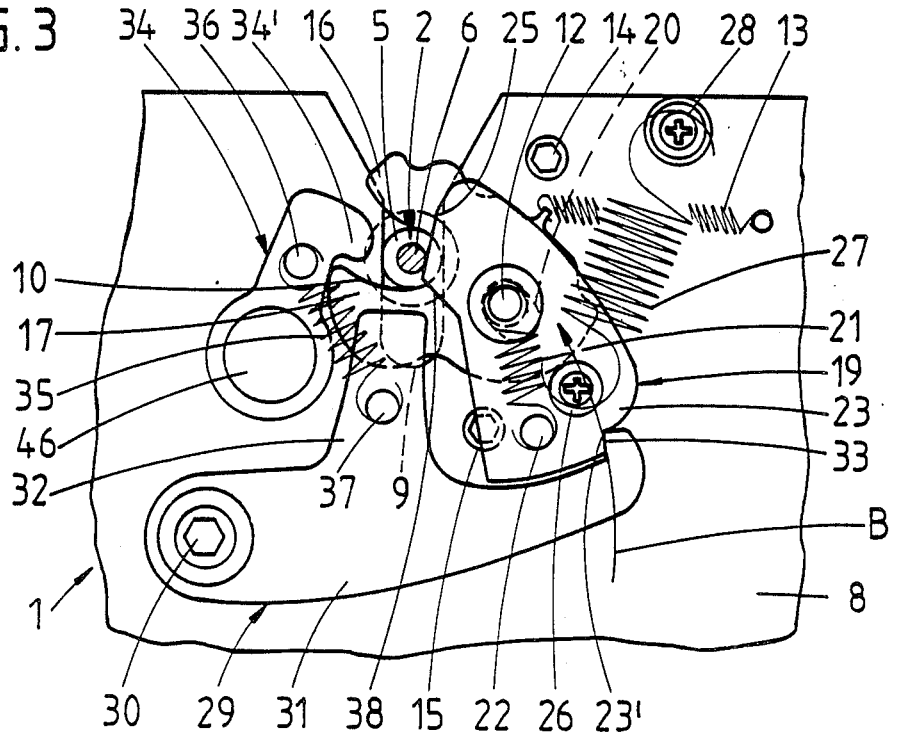
FIG. 3 is an intermediate position upon closing, in connection with which the mating closure part has acted on the control bevel of the auxiliary closure lever and has displaced it.

The following manner of action results:

Upon the closing of the trunk lid 3, the mating closure part 2 comes into the position shown in FIG. 1 and therefore into the region above the widening 9' of the slot 9. The middle position 5 of the mating closure part 2 passes the fork leg 16 and enters into the fork mouth 10; see the dot-dash showing in FIG. 1. At the same time, the end portion 6 of smaller cross section of the mating closure part 2 has come in front of the portion 25' of the control bevel 25. Upon further closing movement and therefore deeper insertion of the mating closure part 2 into the slot 9, the middle portion 5 thereof swings the fork latch 11 into the position shown in FIG. 3. In this connection, the locking end 34' of the locking lever 34 extends into the fork mouth 10. However, it is supported on the end surface of the fork leg 17. Furthermore, the portion 25" of the control bevel 25 of the auxiliary closure lever 19 is acted on by the end section 6 of the mating closure part 2, and said lever is thereby displaced against the force of the tension spring 21. This displacement is directed towards the swing arc B of the stop step 23 of the release lever 29, so that the engagement between auxiliary closure lever 19 and release lever 29 is even further increased. The charged force accumulator K therefore is still not able to swing the auxiliary closure lever 19.

Figure 4:
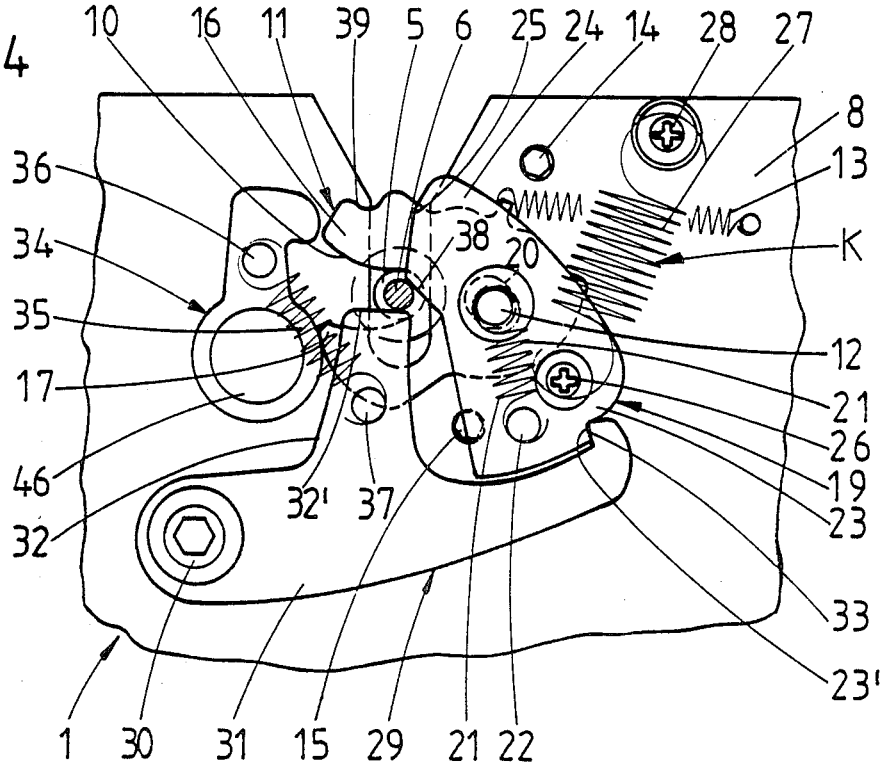
FIG. 4 shows another intermediate position during the closing process, the auxiliary closure lever having entered into the grip-over position.
Figure 5:
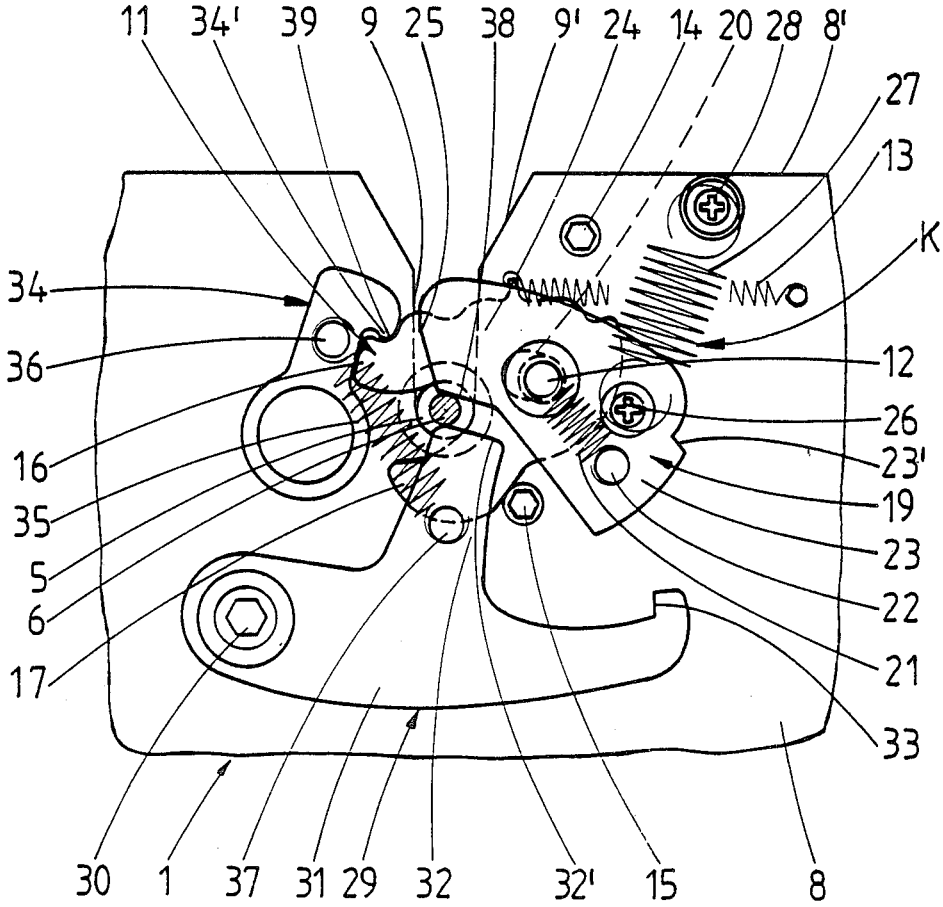
FIG. 5 shows the closing position of the lock with release lever released by the mating closure part and auxiliary closure lever having passed into the pulling-in position.
Figure 6:
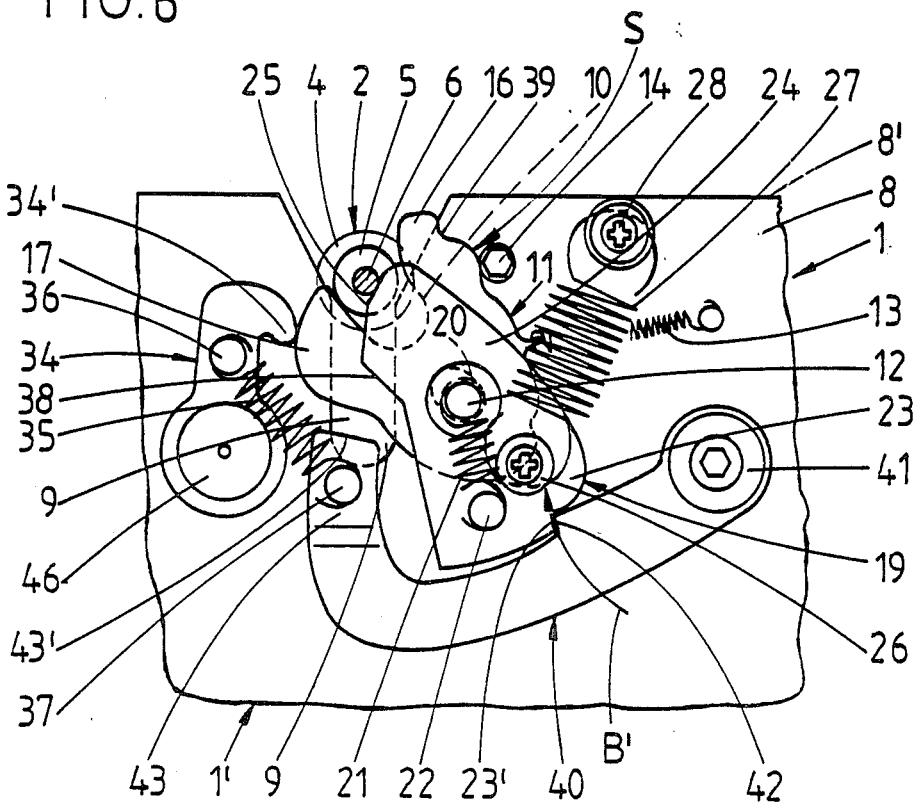
FIG. 6 shows a portion of the lock according to the second embodiment during the closing movement.
Figure 7:
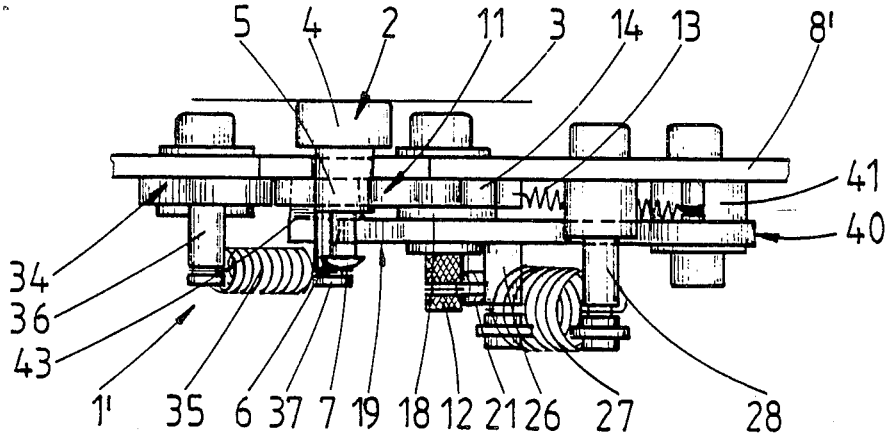
FIG. 7 is a top view of the lock.

In accordance with FIG. 4, the end portion 6 of the mating closure part 2 has passed the control bevel 25 of the auxiliary closure lever 19. The tension spring 21 now effects a rearward displacement of the auxiliary closure lever 19, so that the step 38 of the latter which is adjacent the control bevel grips in part over the end section 6. In this position the locking step 33 of the release lever 29 still grips behind the mating step 23' of the auxiliary closure lever 19. However, the end section 6 has already come in front of the end surface 32' of the T-stem 32 of the release lever and swings the latter upon further displacement, the locking step 33 releasing the mating step 23' so that the auxiliary closure lever 19' is acted on by the tension spring 27, pulls in by its step 38 the end section 6 of the mating closure part and thus brings the trunk lid into the final closed position; see FIG. 5. In this connection the swinging of the fork latch 11 and thus the inward movement is limited by the stop 15 struck by the fork latch. In this position the locking end 34' of the locking lever 34 which was previously controlled by the fork latch 11 engages behind the fork leg 16 and enters into a detent niche 39 thereof.

For the opening of the trunk lid 3, the locking lever 34 is first of all to be swung into a position of release. This can be done, for instance, by the action of a key or from the inside of the vehicle. During the opening movement, the end section 6 acts on the auxiliary closure lever 19 and swings the latter, while charging the force accumulator spring 27.

Furthermore, the fork latch 11 is displaced. In addition to this, the release lever 29 is swung and, after leaving the mating closure part 2, engages behind the mating step 23' of the auxiliary closure lever while maintaining the position shown in FIG. 1.

In the second embodiment of the lock 1', shown in FIGS. 6 to 10, the same parts bear the same reference numbers. The controlling of the release lever 40 is now effected with the interposition of the fork latch 11. The release lever 40 is of hook shape and is mounted on the same side of the slot 9 as the auxiliary closure lever 19. The stud pin 41 on which the release lever 40 is mounted is at a distance from the slot 9 which corresponds to a multiple of the distance between the stud bolt 12 and slot 9. In the region of the inner surface of its hook, the release lever 40 forms the stop step 42 for the mating step 23' of the auxiliary closure lever 19. This means that release lever 40 and auxiliary closure lever 19 lie in the same plane, as in the case of the first embodiment. In order that the release lever 40 can cooperate with the fork latch 11, its hook end 43 is bent in the direction towards the support plate 8 in such a way that it lies in the plane of the fork latch 11. The hook end 43 bears the pin section 37 which serves for the attachment of the tension spring 35 which extends from the locking lever 34.

Figure 8:
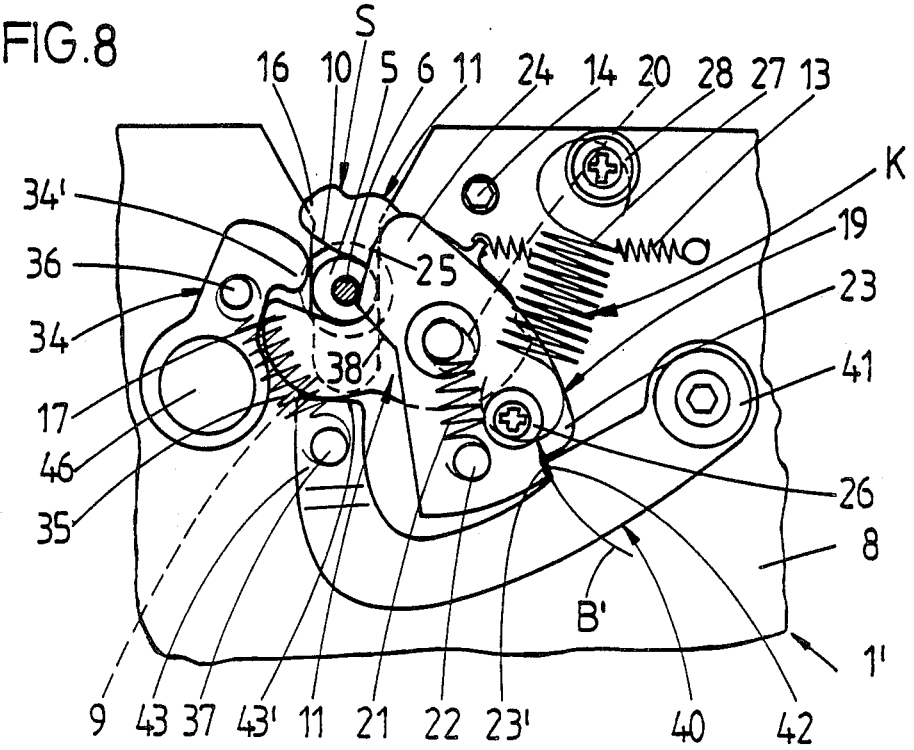
FIG. 8 shows an intermediate position in which the mating closure part displaces the auxiliary closure lever via the control bevel.
Figure 9:
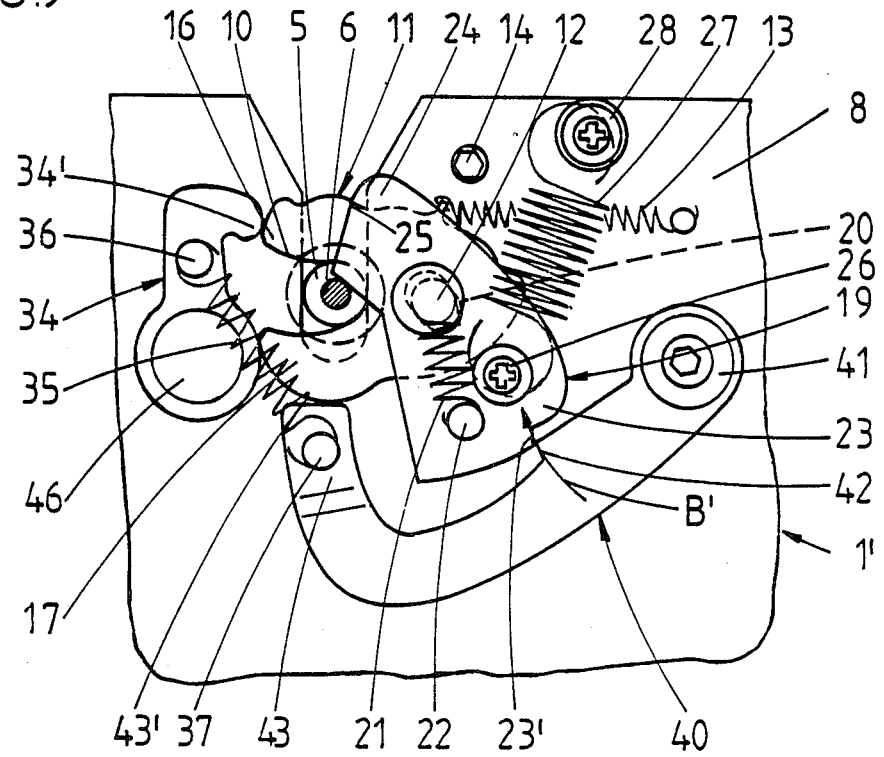
FIG. 9 shows a further intermediate position in which the auxiliary closure lever grips over the mating closure part but still in the secured position of the release lever.
Figure 10:
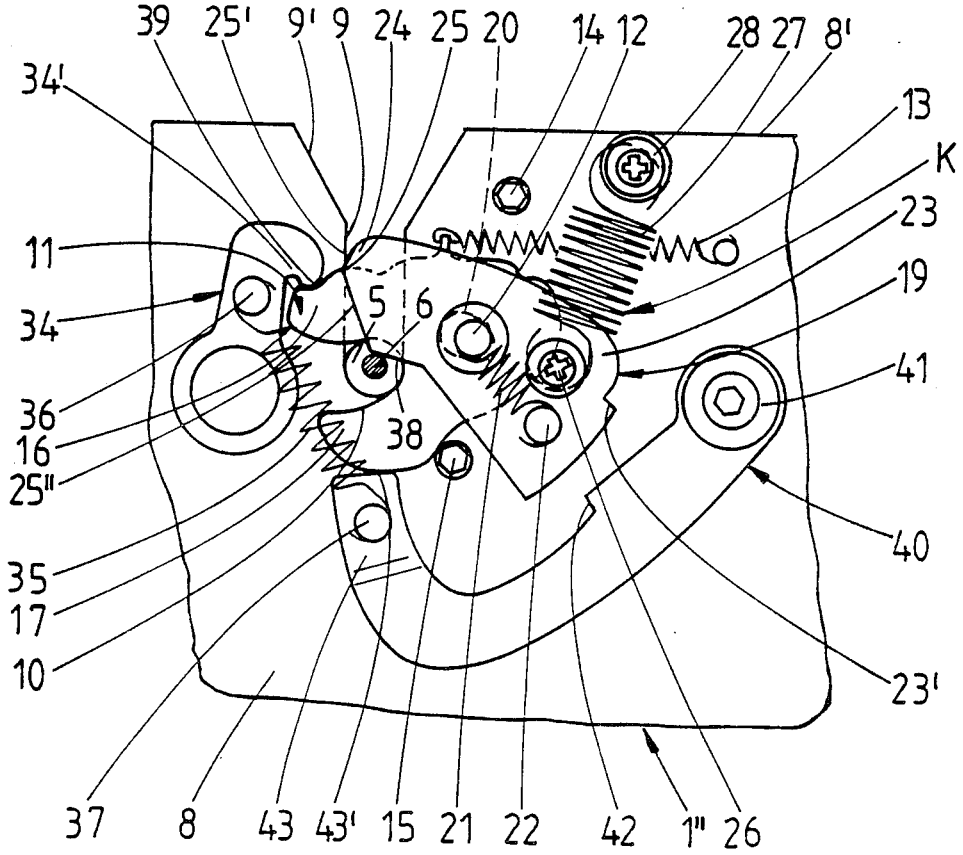
FIG. 10 shows the closed position of the lock with release lever released by the fork latch and auxiliary closure lever swung.

Upon closing the trunk lid, the end section 6 of the mating closure part 2 strikes against the control bevel 25 of the auxiliary closure lever 19 and pushes the latter into the position shown in FIG. 8. At the same time, the fork latch 11 is swung by the middle portion 5 of the mating closure part 2, so that it comes in front of the end surface 43' of the hook end 43 of the release lever 40. Upon further closing, the position in accordance with FIG. 9 is brought about, in which position the auxiliary closure lever engages over the end section 6 of the mating closure part 2 as a result of the rearward displacement of said lever, caused by the tension spring 21. The auxiliary closure lever 19 can, however, still not be swung under the action of the force spring due to the fact that it is secured by the stop step 42 of the release lever 40. Only upon slight further displacement and as a result of the swinging of the fork latch 11, which comes against the end surface 43' of the hook, does there take place the further moving of the release lever 40 with release of the auxiliary closure lever 19, which then leads to the pulling of the mating closure part into the position shown in FIG. 10. This position is secured by the locking lever 34. The opening of the lock in accordance with this embodiment also effects a charging of the force accumulator K with simultaneous swinging of the auxiliary closure lever 19 and securing thereof by the release lever 40.

Figure 11:
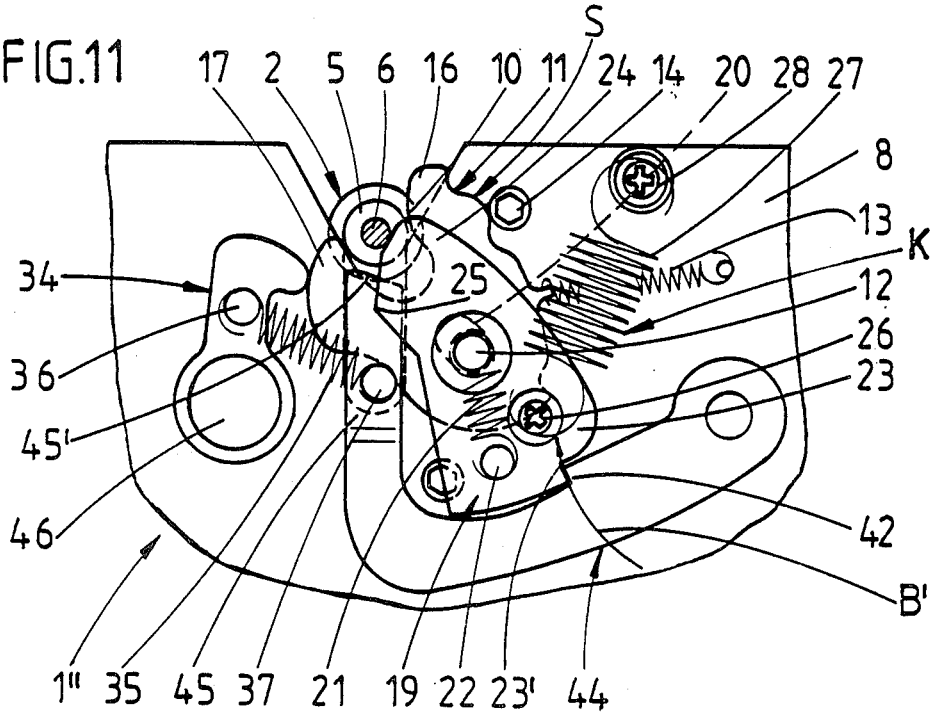
FIG. 11 is a view of the lock according to the third embodiment, with the mating closure part moving into the fork mouth of the fork latch and therefore during the closing of the trunk hood.
Figure 12:
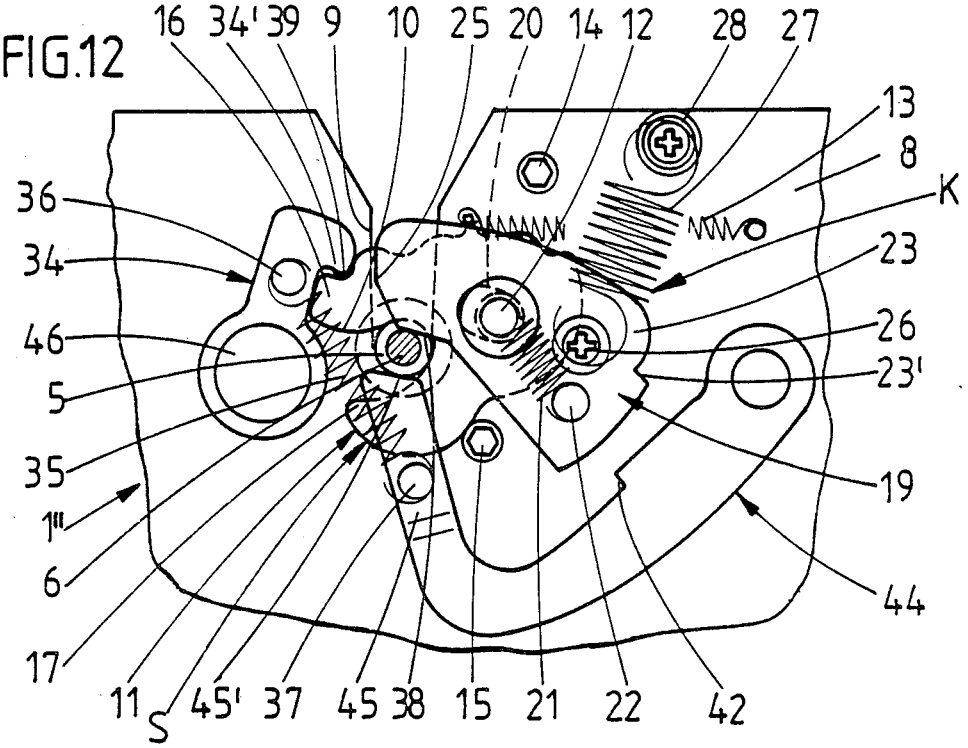
FIG. 12 is a showing corresponding to FIG. 11 but concerning the closed position of the lock.

In the third embodiment of the lock 1", shown in FIGS. 11 and 12, the control of the release lever 44 is effected by the mating closure part 2, namely by the middle step 5 thereof. The construction of the release lever 44 corresponds substantially to that of the release lever shown in the second embodiment. To be sure, the hook end 45 is longer and extends, in the open position of the lock, by means of its hook end surface 45', in part into the fork mouth 10.

Upon effecting the closed position, the auxiliary closure lever 19 is acted on by the end portion 6 of the mating closure part 2 and, in an intermediate closing phase, said lever then grips over the end portion 6. At the same time, the middle portion 5 acts on the end surface 45' of the bent-off hook end 45 and thereby brings the release lever 44 into the position of release so that the force accumulator tensile spring 27 can swing the auxiliary closure lever 19 with the pulling of the mating closure part into the position shown in FIG. 12 in which the fork latch 11 is secured against backward swinging by the locking lever 34.

In both of the embodiments last described, the displacement of the auxiliary closure lever 19 effected by the mating closure part 2 takes place in the direction towards the swing arc B' of the stop step 42.

Figure 13:
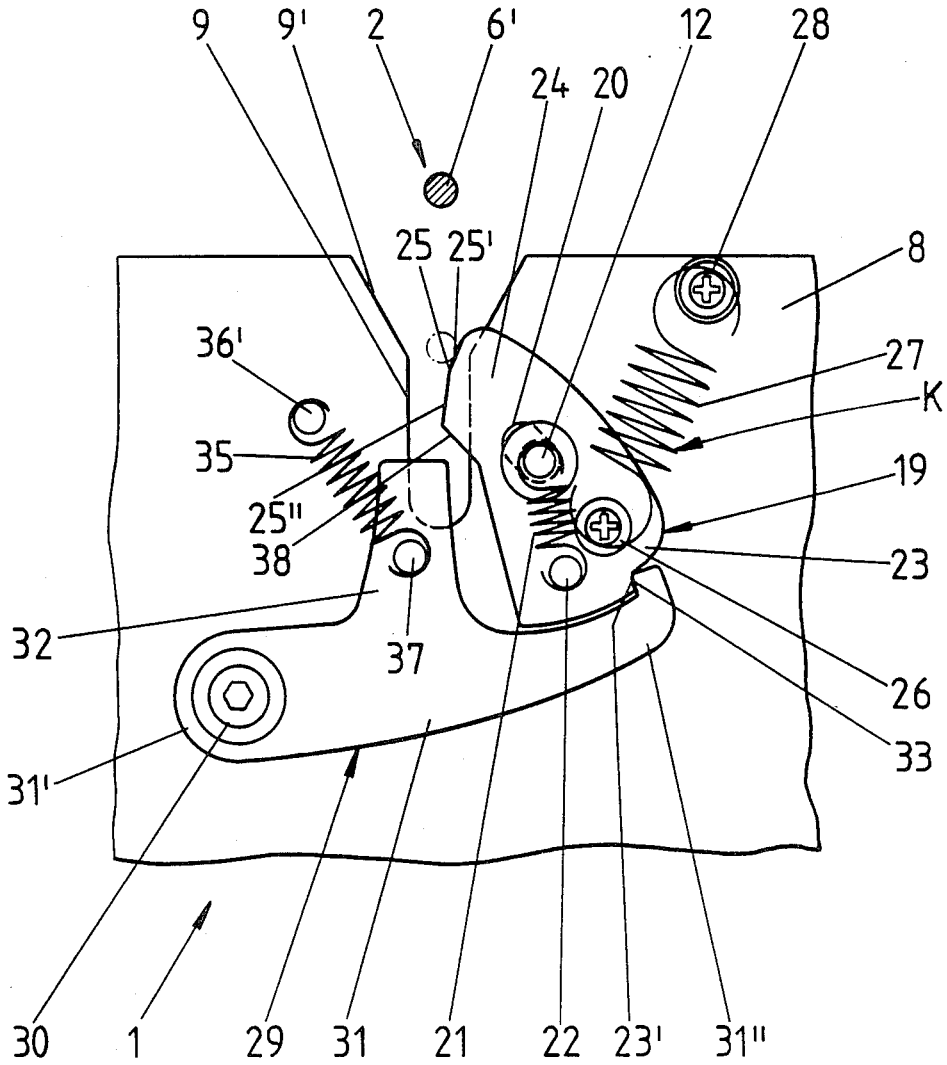
FIG. 13 is a view of part of the lock in accordance with the fourth embodiment.

The fourth embodiment, shown in FIG. 13, corresponds substantially to the first embodiment. The same structural parts therefore bear the same reference numbers. In this embodiment both the fork latch and the locking lever are lacking. They can be arranged at a suitable place of the lock, not shown. Accordingly, the mating closure part 2 forms a portion 6' which controls the auxiliary closure lever 19 and release lever 20, the portion 6' is being formed separated from the portion which cooperates with the fork latch.

Upon closing the trunk lid or the door, the auxiliary closure lever and release lever are actuated in equivalent manner, the fork latch which is arranged at a suitable place of the lock, simultaneously entering into engagement. The release lever 29 is under spring load. The corresponding tension spring 35 engages on the pin section 37 of the release lever 29 and on a stud bolt 36' which is on the lock-housing side.

In accordance with the fifth embodiment, shown in FIGS. 14 to 20, hinged part which is associated with an automotive vehicle bears the reference number 47.

From the hinged-side end of the part 47 there extend, directed towards the inside of the vehicle, one or two lugs 48 arranged on both sides, each lug being passed through by a pin 50 which is arranged on the vehicle chassis 49. Above this pivot point there acts on the lug 48 the piston rod 51 of a gas pressure spring 52 which is fastened on the vehicle chassis 49 and urges the hinged part 47 into the open direction.

At the height of the lug 48, a bearing plate 53 extends from the bottom of the hinged part 47. On a transversely directed pivot bolt 54 thereof there engages the one end 55' of a bar-shaped swing lever 55. The other end 55" thereof is provided with a slot 56 into which a pin 57 of a charging lever 58 engages. The latter is arranged swingably on the vehicle chassis 49 around a pivot pin 59 and forms two arms 58' and 58" at an obtuse angle to each other in such a manner that the pin 57 sits on the shorter arm 58'.

On the central portion of the longer arm 58" of the charging lever 58 the one end of a force accumulator K acts by means of a pivot pin 60. This end is the cylinder 61 of a gas pressure spring 62. The free end of the arm 58" is shaped as a tooth 63 which, in the closed position of the hinged part 47 shown in FIG. 17, has the end 64 of the lever arm 65' of an angular locking member (blocking member) 65 engaged behind it. The other lever arm 65" is under the action of a tension spring 66. The latter biases the locking member 65 in clockwise direction around the pivot pin 101. A stop pin 67 on the chassis side limits this displacement. On the free end of the lever arm 65" there engages a connecting rod 69 which is equipped with a grip eye 68. This connecting rod together with the locking member 65 forms a manually releasable release device F. The grip eye 68 can be so associated with the vehicle that remote release is possible. The point of attack for the connecting rod 69 is formed by a pivot pin 70.

Furthermore, the free end of the lever arm 65" of the locking member 65 is coupled via the pivot pin 70 to a transmission rod 71. The latter extends approximately horizontally and is provided on its free end with an elongated hole 72 into which the coupling pin 73 engages, with the formation of a free path between the locking member (blocking member) 65 and a locking pawl 74. The pawl is developed with a single arm and is mounted on a pin 75. Its locking tooth 76 which is provided on its central portion cooperates with preliminary and main detent recesses 77, 78 of a closure part (lock part) S which is swingable about a pivot shaft 79. The closure part S is developed as a fork latch 80 with a fork mouth 81 which is arranged in front of the preliminary and main detent recesses. The fork-latch tail 82 bears a transverse pin 83. On it there acts a tension spring 84 which extends from the coupling pin 73 of the locking pawl 74 and acts on the fork latch 80 and locking pawl 74 in all cases against each other in such a manner that, for instance, in the closed position, the locking tooth 76 of the locking pawl 74 enters into the main detent recess 78 of the fork latch 80.

The transverse pin 83 furthermore cooperates with the facing edge of the arm 85' of an angularly shaped release member 85. For the mounting thereof on the chassis 49 a pivot pin 86 is employed. The other arm 85" of this release member 85 is provided at its end with a locking shoulder 87 which, when the hinged part is open in accordance with FIG. 14, lies in front of a bent-over stop 88 of a single arm pull lever 89. The pivot point 90 of the latter extends below the pivot shaft 79 of the fork latch. A tension spring 91 which acts on the arm 85" sees to it that, with the hood 47 open, the locking shoulder 88 lies in front of the stop 87 of the pull lever 89. Furthermore, the pull lever 89 extends in the plane of the fork latch. The pull lever 89, at its free end, forms an approximately semi-circular push shoulder 92 which is associated with the fork latch tail 82 and rests as a result of the force accumulator K against a facing control surface 93 of the fork latch tail 82. The piston rod 94 of the gas pressure spring 62 engages at the height of this pressure shoulder 92 in articulated fashion on the pull lever 89.

This pull lever 89 is under the action of a tension spring 95 which urges the pull lever against the force of the gas pressure spring. The force of the tension spring 95 is, however, less than that of the charged force accumulator K.

In order that the push shoulder 92 of the pull lever 89 does not slip off from the control surface 93 of the fork-latch tail 82, the latter is provided with a holding nose 96 on its end.

Figure 14:
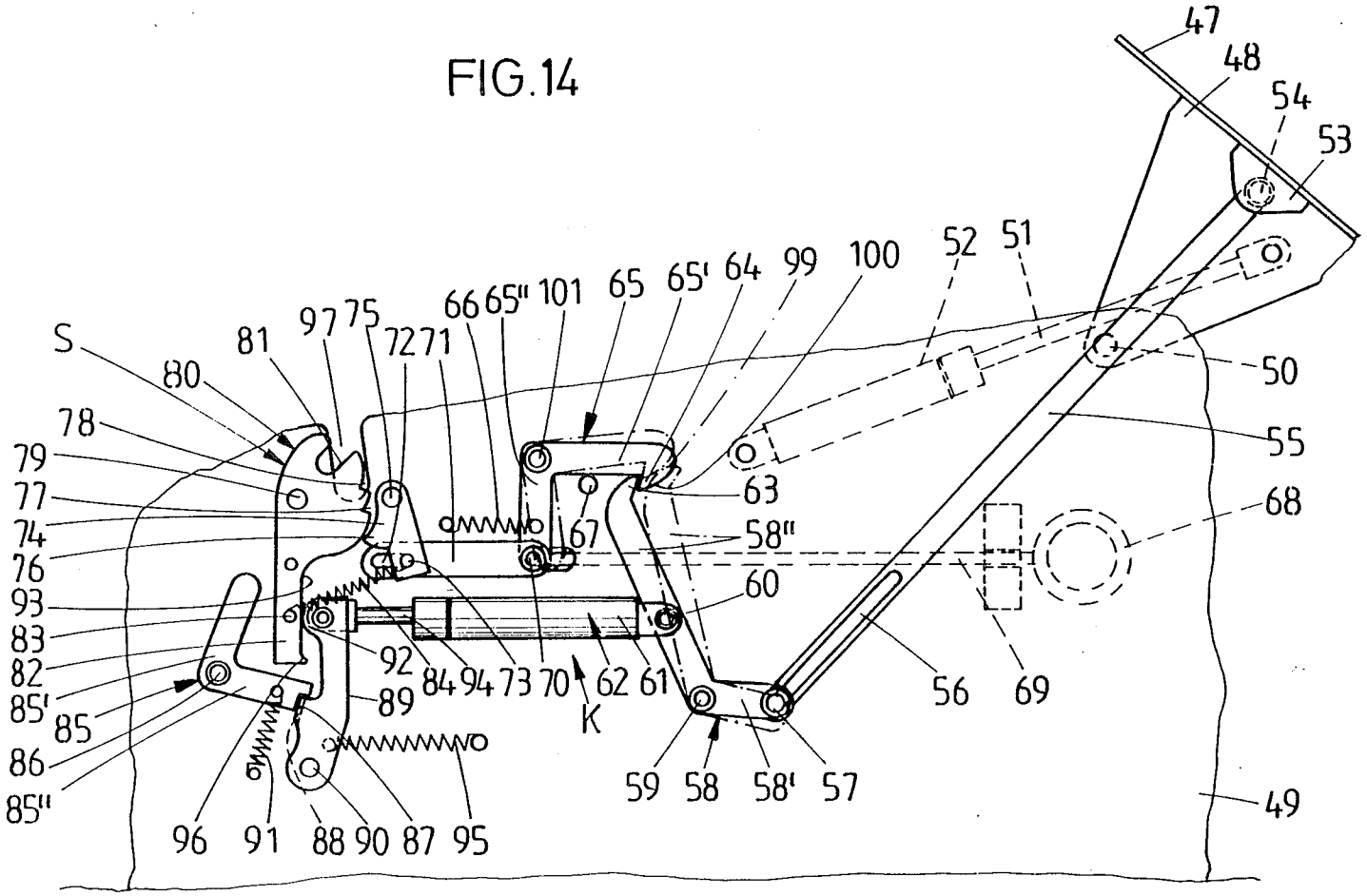
FIG. 14 is a view of the lock according to the fifth embodiment, with hood open and force accumulator charged.

The manner of operation of this lock is as follows:

In FIG. 14 the hinged part 47 is open. The pull lever 89 which is acted on by the force accumulator has its stop 88 resting against the locking shoulder 87 of the release member 85. The fork mouth 81 then extends into the entrance slot 97 for the eye-shaped mating closure part 98. Furthermore the hook end 64 of the locking member 65 blocks the charging lever 58 which represents an abutment for the force accumulator K. The gas pressure spring 52 holds the hinged part 47 in the swung-open position in which the pin 57 lies against one end of the slot 56 of the swing lever 55. Furthermore, in this position the swing lever 55 extends close to a dead-center line, exceeded by it, which passes through the pin 50.

Figure 15:
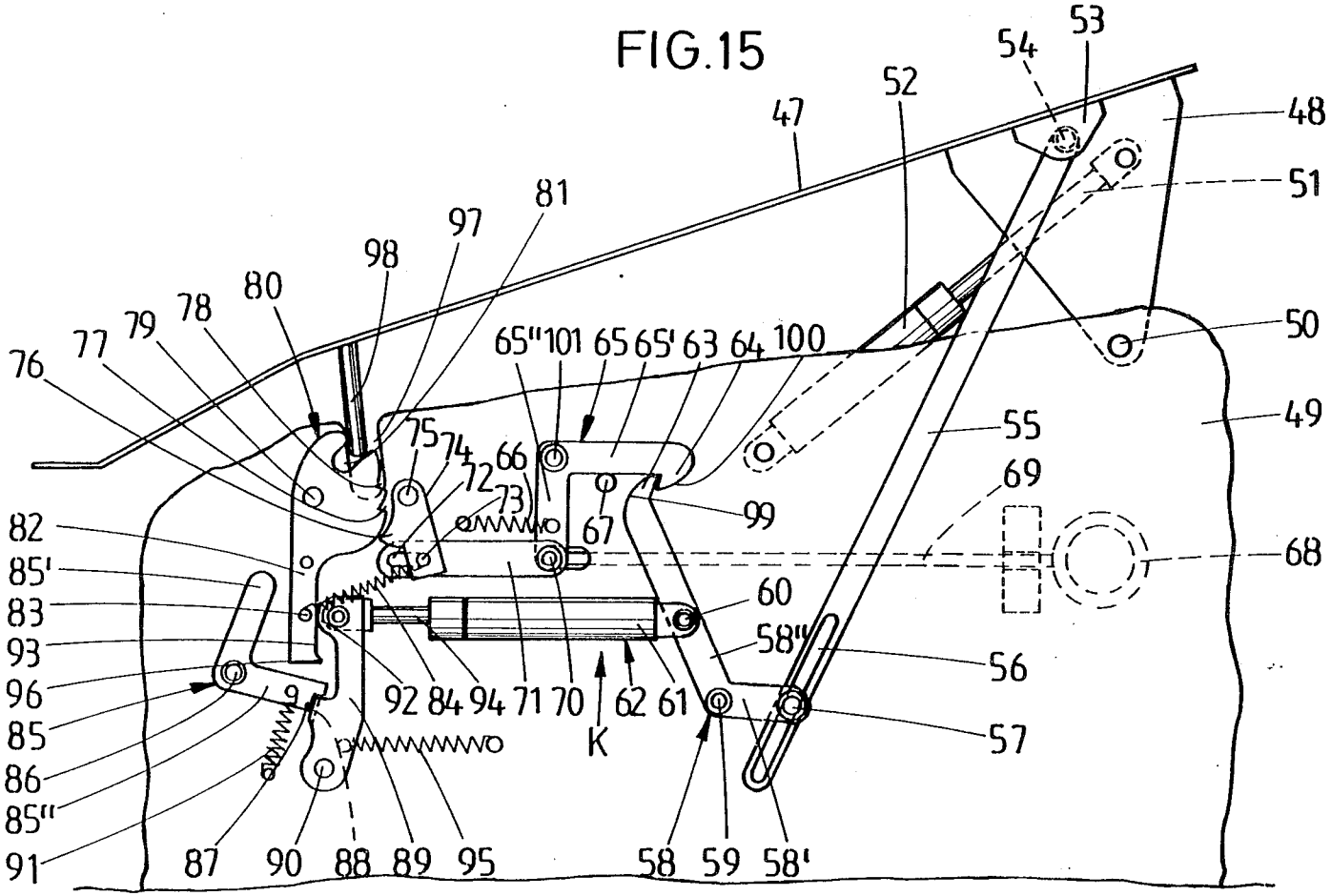
FIG. 15 is a showing corresponding to FIG. 14, with hood in the final phase of closing, the mating closure part having reached one arm of the mouth of the fork of the fork latch.
Figure 16:
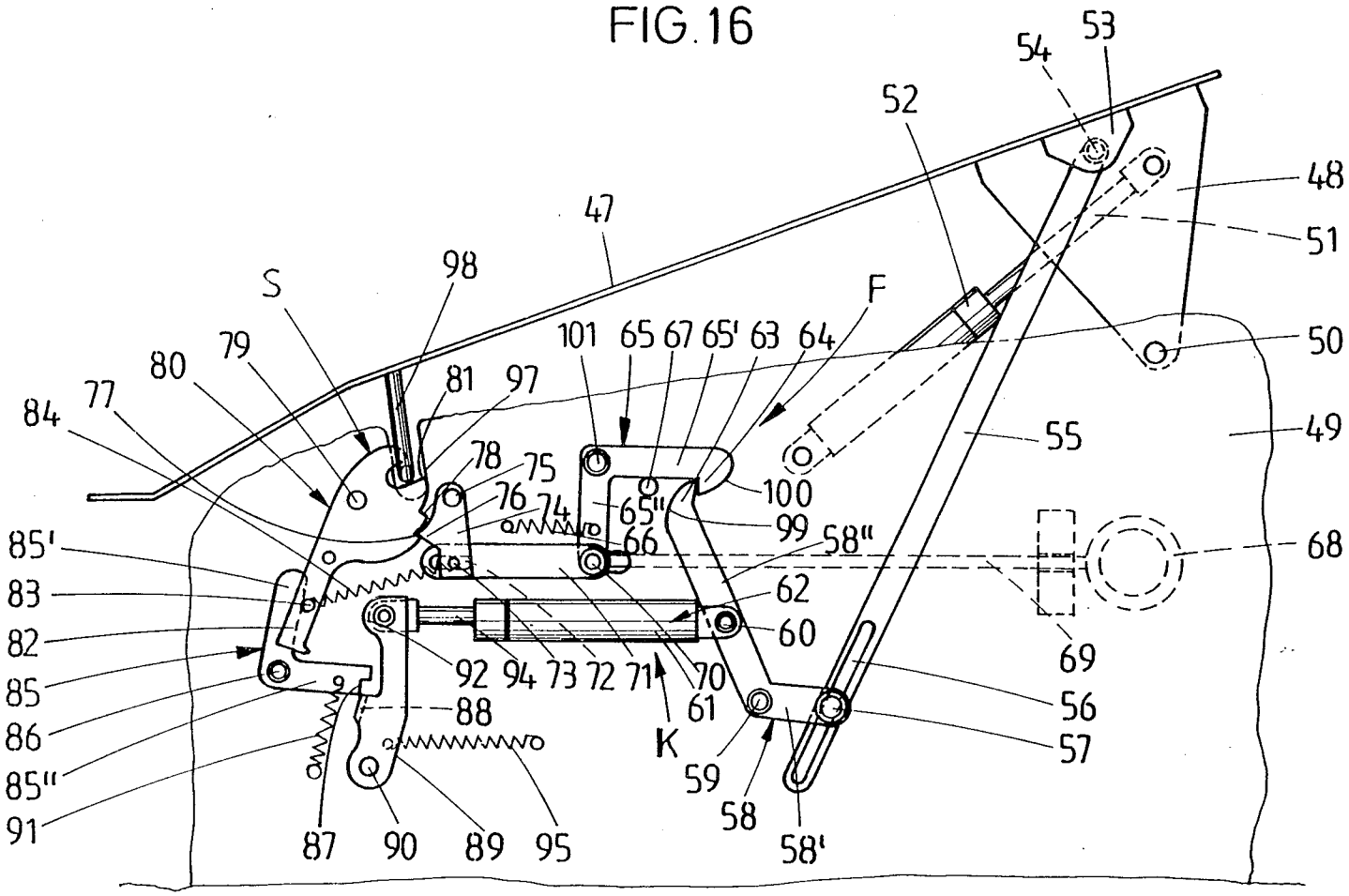
FIG. 16 is a corresponding showing concerning the preliminary position in which the fork latch has moved the release member into the release position.
Figure 17:
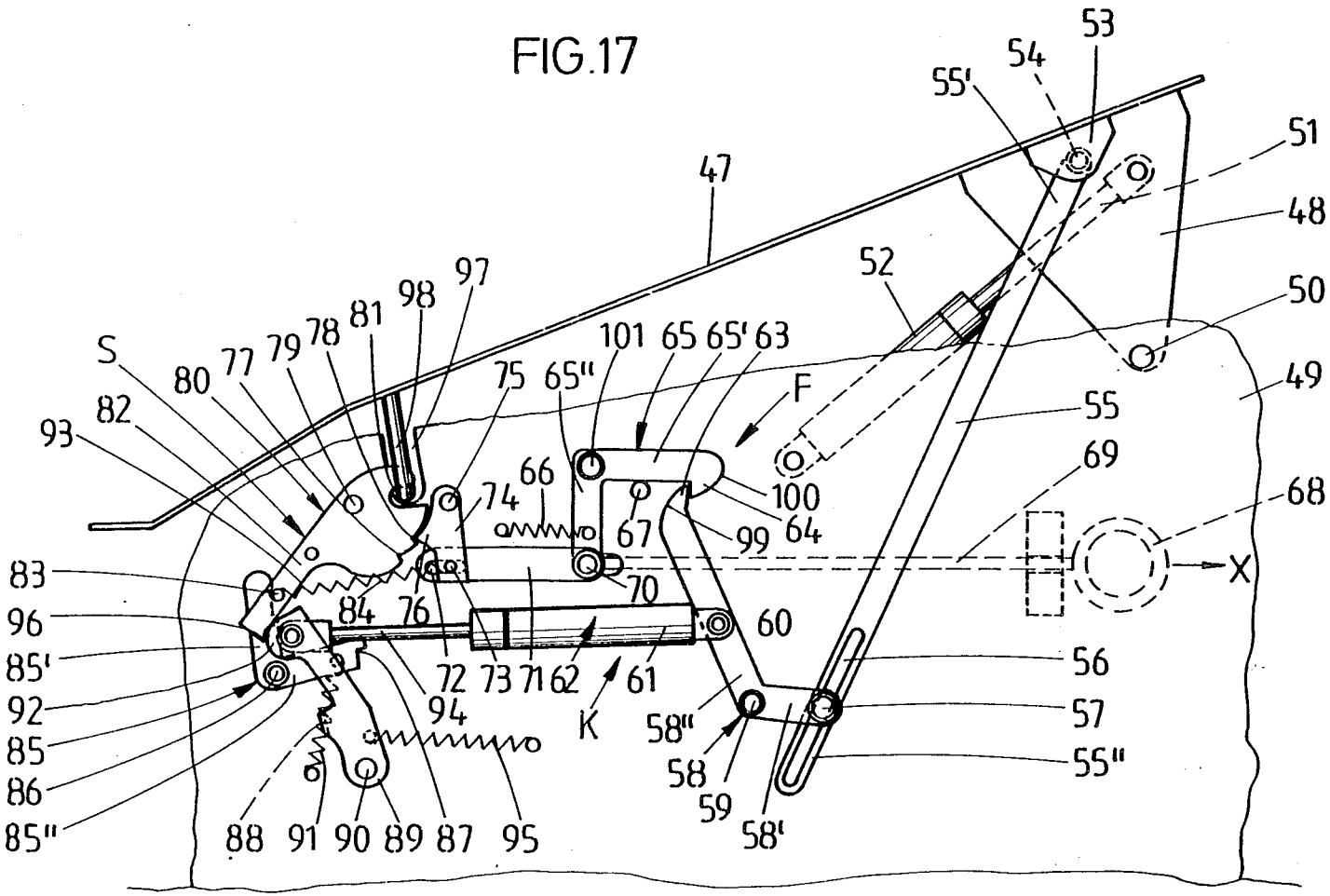
FIG. 17 shows the lock in the closed position and therefore with the hood closed.

Upon the closing of the hinged part 47, the mating closure part 98 acts on the fork latch 80 in the region of the fork-mouth opening 81; see FIG. 15. Upon further entrance of the mating closure part 98 into the entrance slot 97, the fork latch 80 is moved into the position shown in FIG. 16. The locking tooth 76 of the locking pawl 74 comes into the pre-detent recess 77 of the fork latch. At the same time, the one arm 85' of the release member 85 is acted on via the transverse pin of the fork-latch tail 82. In this way, the locking shoulder 87 of the other arm 85" changes its position with respect to the stop 88 of the pull lever 89, so that upon further displacement of the hood 47 in the closing direction of the pre-detent position, the release of the pull lever takes place with time delay and the force accumulator K can then discharge. Since the cylinder end thereof is blocked by the locking member 65, the discharge can take place only by swinging of the pull lever 89, the pressure shoulder 92 of which acts on the control surface 93 of the fork latch 80 and swings the latter in clockwise direction, further pulling the mating closure part 98 into the closed position shown in FIG. 17. The locking-pawl/locking tooth 76 can then engage into the main detent recess 78 and secure the fork latch 80 against turning backward. In this position the blocking engagement between locking member 65 and charging lever 58 is maintained. Furthermore, the pin 57 extends on the middle portion of the slot 56 of the swing lever. The pull lever 89 is under the action of the tensioned tension spring 95.

Figure 18:
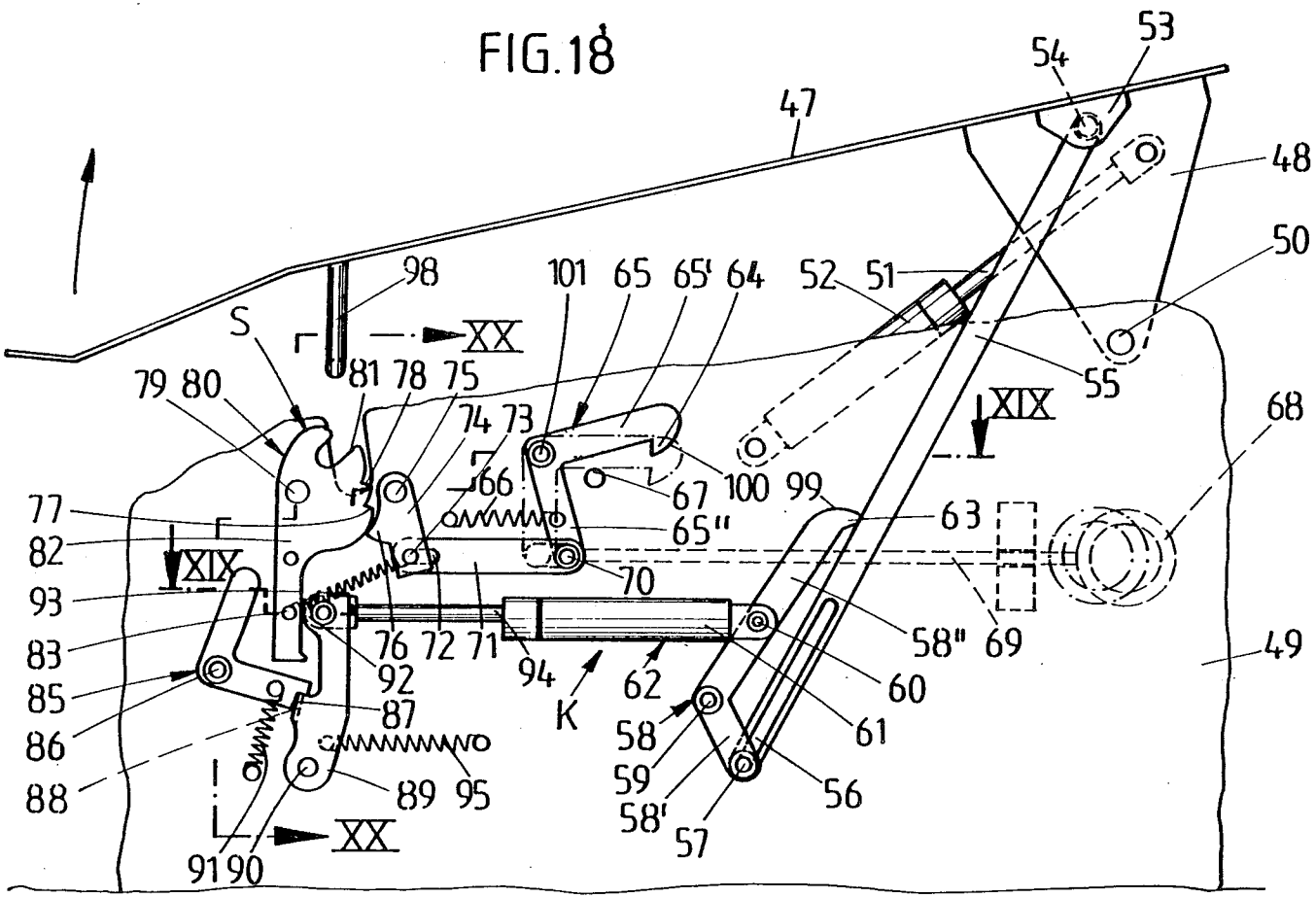
FIG. 18 shows the lock after the release, the mating closure part having left the fork latch.
Figure 19:
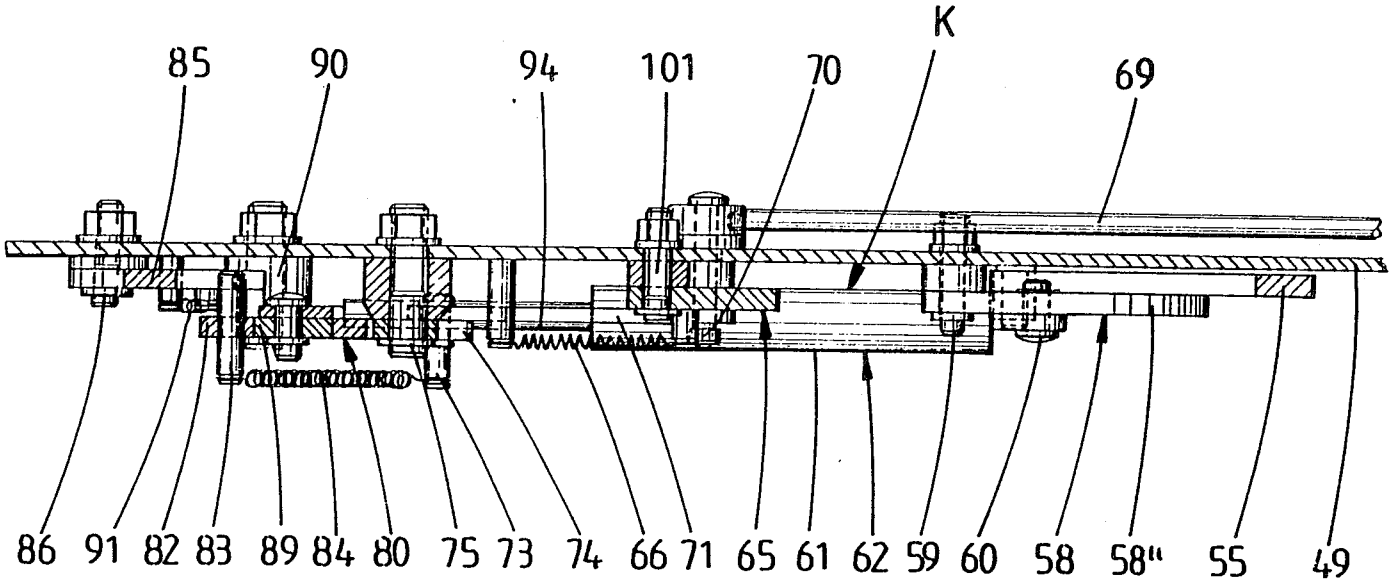
FIG. 19 is a section along the line XIX—XIX of FIG. 18.
Figure 20:
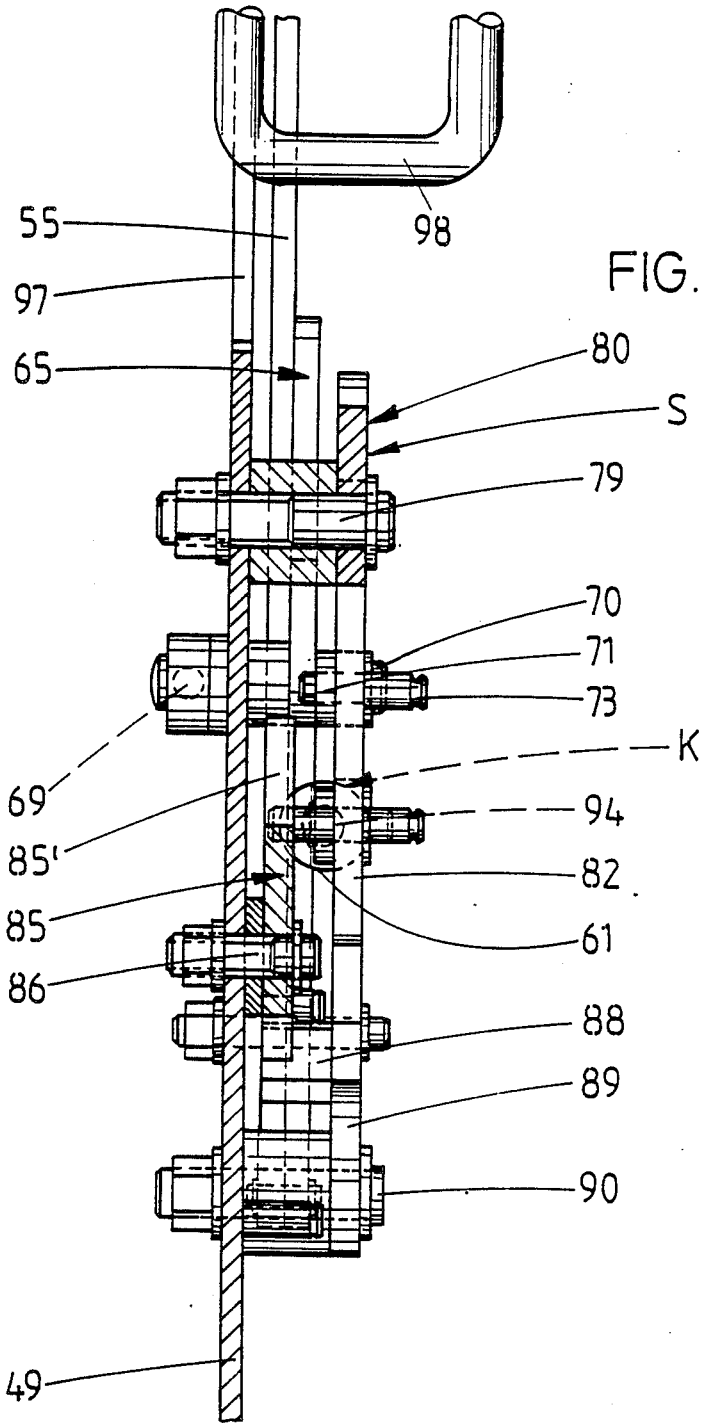
FIG. 20 is a section along the line XX—XX of FIG. 18.

For the opening of the lock, the connecting rod 69 must be shifted by the trip eye 68 in the direction indicated by the arrow x into the position shown in FIG. 18. Simultaneously with this, the locking member (blocking member) 65 swings and its hook end 64 releases the charging lever 58. At the same time, the locking pawl 74 is swung in counterclockwise direction via the transmission rod 71, after elimination of the free motion (free path) between coupling pin 73 and slot 72, in such a manner that its locking tooth 76 leaves the main detent recess 78 of the fork latch 78. During this process, the pull lever 89 is swung via the tension spring 95. The discharging force accumulator K thereby displaces the charging lever 58 in clockwise direction, its pin 57 coming into the region of the lower end of the slot 56 of the swing lever 55. The free motion between charging lever 58 and swing lever 55 is thus eliminated. The fork latch 80 is also turned via the tension spring 84. The transverse pin 83 of the fork-latch tail 82 moves away from the release member 85 and permits the latter also to effect a spring-biased swinging in clockwise direction. In this way, the locking shoulder 87 passes in front of the stop 88 of the pull lever 89. With the release of the mating closure part 98, the gas pressure spring 52 has also swung the hinged part 47 slightly into an open-slit position. Upon the further opening of the hinged part 47, the charging lever 58 is immediately swung by the pin 57 present at the end in the slot 56, in which connection the charging of the force accumulator takes place since the piston-rod end cannot move away due to the blocked position of the pull lever. During the opening displacement of the hinged part, the rounded edge 99 on the end of the charging lever arm 58" acts on the facing latch rounding 100 of the locking member 65 and swings it in opposition to its spring charge into the dot-dash position shown in FIG. 14 so that the hook end 64 can engage behind the tooth 63 of the charging lever and thus block the latter, while preventing an unintended discharging of the force accumulator K.

The force accumulator springs 62 and 52 are so adapted to each other that the hinged part 47 remains approximately in balanced condition in the position in which it is.

A reversal is also conceivable in the manner that the mating closure part is associated with the vehicle chassis and the fork latch is associated with the other lock parts of the hood.

In the invention, the charging of the force accumulator K can also be effected by the closing movement of the hood. In accordance with the embodiment shown in FIGS. 14 to 20 this can take place by the following modification which is not shown in the drawing:

The swing lever 55 has no slot 56 but acts the end by a ratchet-tooth attachment on the charging lever 58 in the region of the charging-lever arm 58". The charging lever 58 is carried along via the ratchet-tooth connection when the hood 47 is brought from its open position into the closed position, the charging lever 58 being swung in counterclockwise direction and charging the force accumulator K. Shortly before reaching the release position upon the closing of the hinged part 47, the charging lever 58 is blocked by a locking member 65. The pulling in of the mating closure part 98 is effected in the manner described in connection with the embodiment of FIGS. 14 to 20. If the remote release is now actuated by means of the grip eye 68, then, upon this process operation, another lever (not shown) must be so swung by the remote release that it lifts the swing lever 55 so that the ratchet-tooth connection comes out of engagement. In this way the charging lever 58 can assume the position shown in FIG. 18. If the remote release returns into its basic position, then the swing lever 55 is again lowered, so that ratchet-tooth engagement is again present. Upon bringing the hinged part 47 into open position, the free motion of the ratchet-tooth connection enters into action, i.e. the charging lever 58 is carried along.

The invention is not limited to swingably arranged hoods, lids or doors but can be applied for instance also to sliding doors.

The sixth embodiment, shown in FIGS. 21 to 25, is so developed that the charging of the force accumulator K is also effected by the closing movement of the hinged part 102. The latter bears at its end opposite the hinge shaft 103 a mating closure part 104 which is bent in eye-shape and cooperates with a fork latch 105. The latter is swingable around a shaft 106 of a lock housing 107. A pre-detent recess 110 and a main detent recess 111 are arranged in front of the latch fork mouth 108 which extends into a top entrance slot 109 of the lock housing 107. The fork-latch tail 112 bears a transverse pin 113 on which there acts a tension spring 114 which urges the fork latch 105 in counterclockwise direction into the open position. The other end of the tension spring 114 is fastened on a pin 115 of the lock housing 107. On the pin 115 there acts another tension spring 116 which swings in clockwise direction a locking pawl 118 which is swingable about the bearing pin 117. The locking pawl is developed as an angle lever in the manner that one lever arm 118' forms a locking tooth 119 which rests against the fork latch 105. The tension spring 116 acts on the other lever arm 118" which at its end bears a coupling pin 120. The latter passes through a short slot 121 in a transmission rod 122. The end of this transmission rod 122 which is opposite the slot 121 is coupled via a pivot pin 123 to one lever arm 124 of an angularly shaped release lever 125. A pivot bolt 126 on the lock housing side passes through the release lever 125 at its vertex. The pivot bolt 126 is at the same time the holder of a torsion spring 127 which biases the release lever 125 in clockwise direction. A stop 128 on the lock-housing side limits the spring-biased swinging motion of the release lever 125. A connecting rod 130 of a remote actuating device acts on the other lever arm 129.

Around the shaft 106 which supports the fork latch there is also swingably arranged a pull lever 131. The latter has a single arm and is provided at its end with a locking tooth 132 which cooperates with a locking shoulder 133 of a release member 134. The release member is developed as a single arm rocker which is acted on in the direction of the fork latch 105 by a compression spring 135. The rocker bearing pin 136 thereof on the housing side is located at the end adjacent the release lever 125. The other end of the rocker or release member 134 is provided with a run-on bevel 137 which faces the latch tail 112. The release member 134 receives its stop limitation by a stop 138 on the lock-housing side which is opposite the compression spring 135.

In the vicinity of the locking tooth 132 of the pull lever 131, the piston rod 140 of a gas pressure spring 141 forming the force accumulator K acts on said lever by means of a pivot pin 139. The pull lever 131 is provided in the region of the pivot pin 139 with a push shoulder 142 which comes against the latch tail 112. On a transverse pin 143 of the pull lever 131 there also acts a tension spring 144 which, like the other tension springs, extends from the pin 115 and urges the pull lever 131 in counterclockwise direction.

Figure 22:
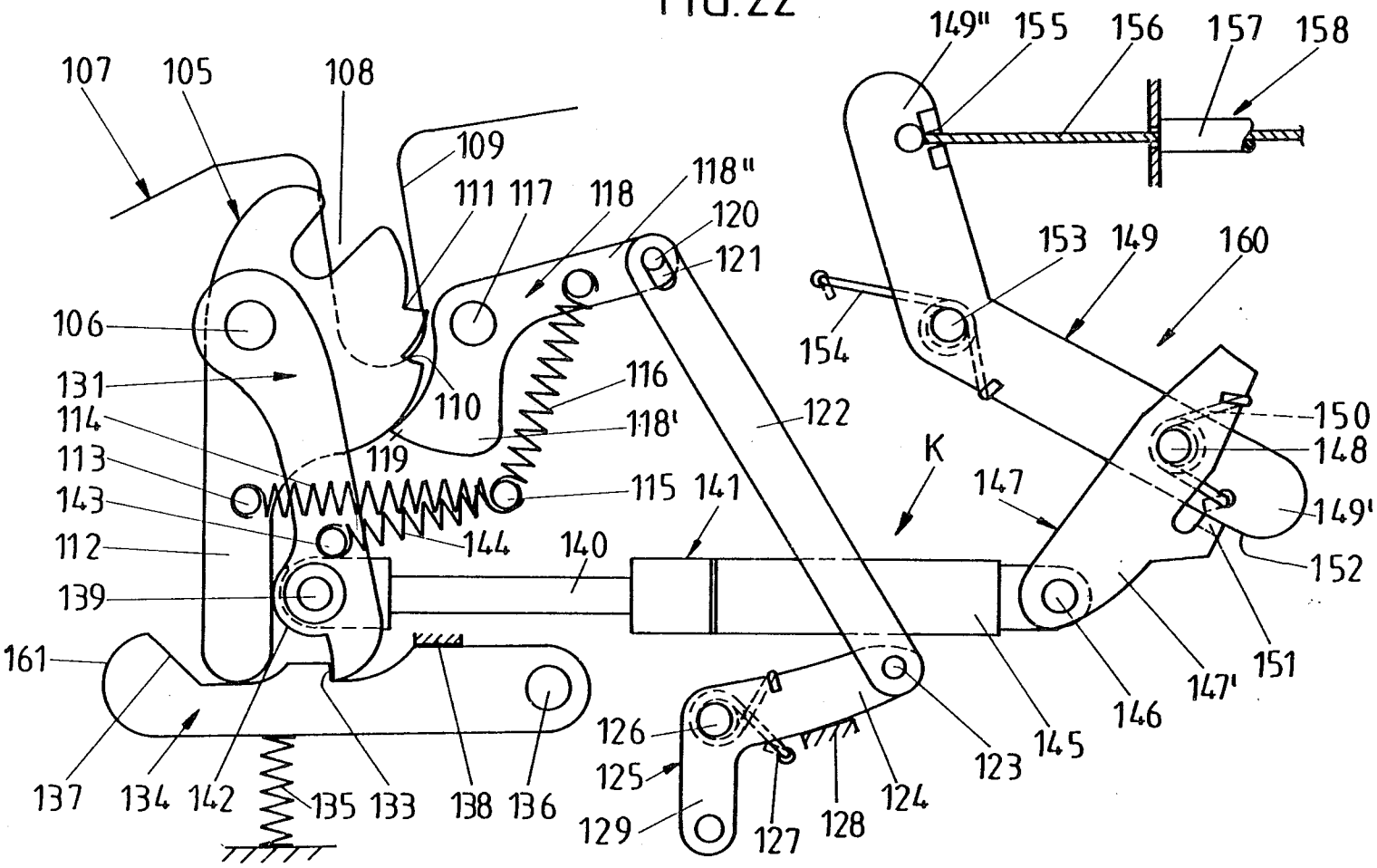
FIG. 22 shows, on a larger scale, the lock structural parts in this opening position.
Figure 23:
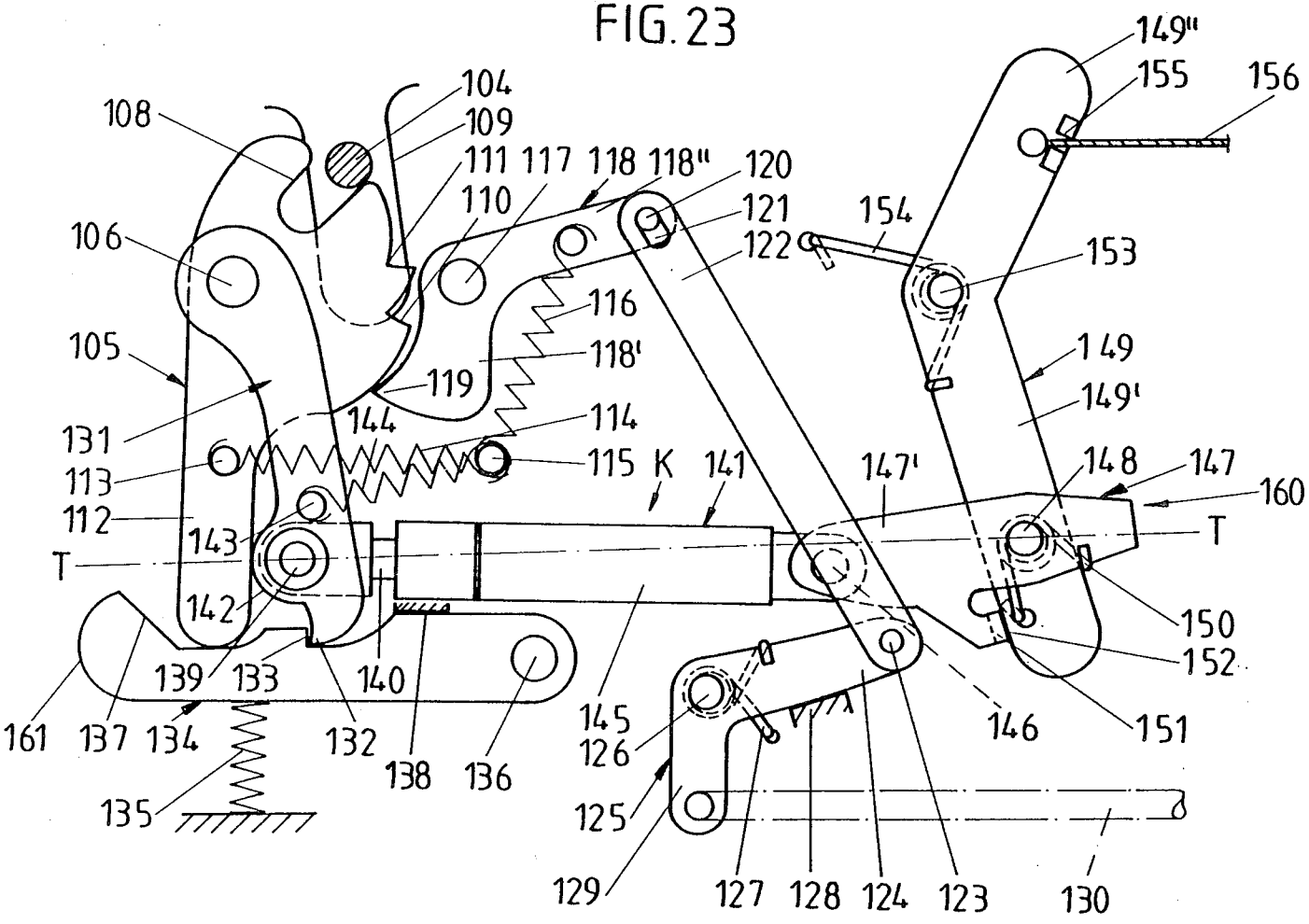
FIG. 23 is a showing corresponding to FIG. 22 but during the closing movement of the hood, with the force accumulator being already charged.
Figure 24:
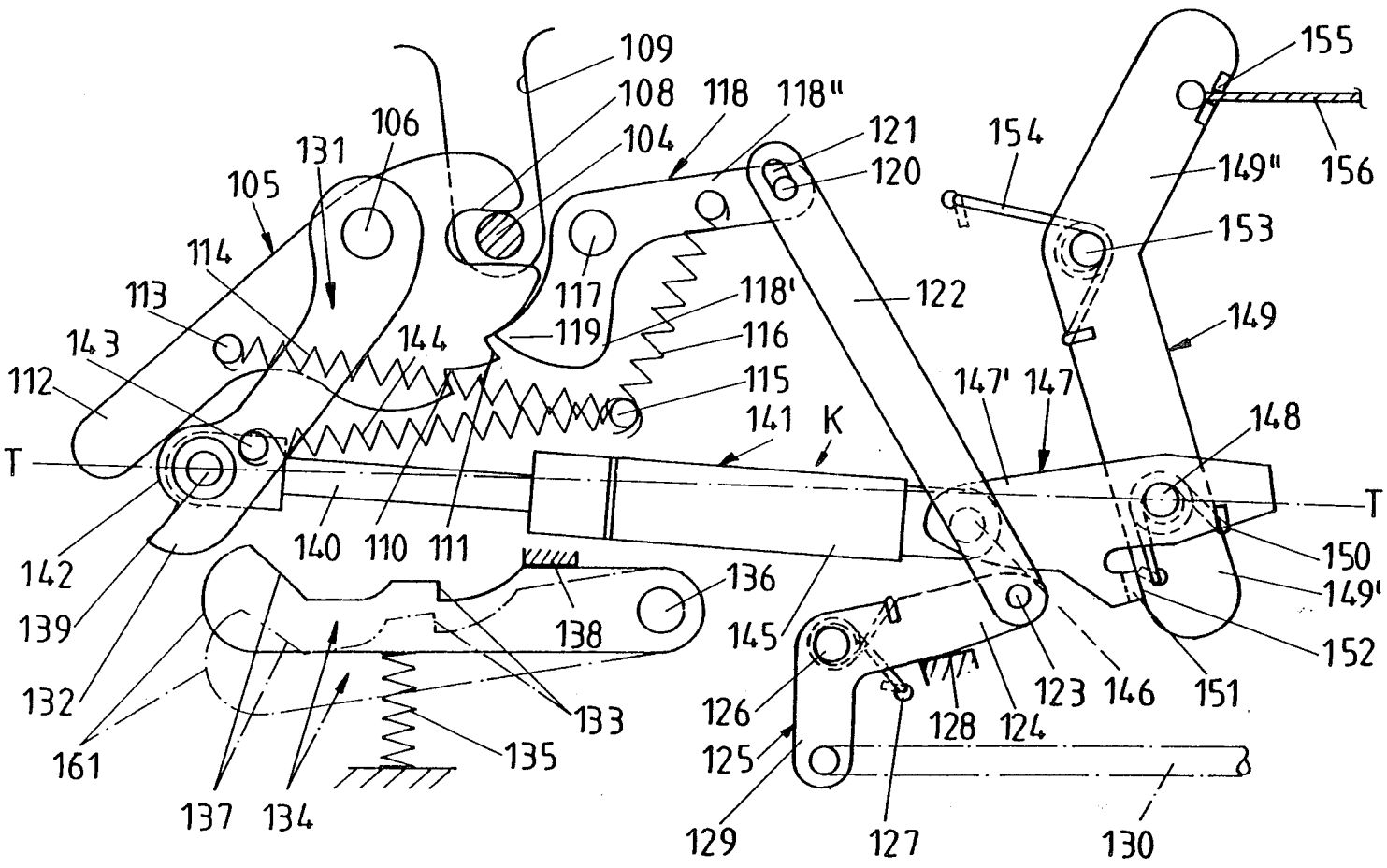
FIG. 24 shows the lock structural parts in the closed position of the hood.

The end of the cylinder 145 of the gas pressure spring 141 which is opposite the piston rod 140 is pivotally coupled via a pivot pin 146 to the one arm 147' of a double-arm push lever 147. The latter is mounted swingably on a transverse pin 148 of a double-arm tensioning lever 149. The transverse pin 148 is arranged on the longer lever arm 149' of the tensioning lever, near the free end thereof. Around the transverse pin 148 there is wound a torsion spring 150 which urges the push lever 147 in counterclockwise direction, said lever resting as shown in FIG. 22, via a stop 151 on the corresponding narrow edge 152 of the lever arm 149'. This position is the tensioning position for the charging of the force accumulator K in accordance with FIG. 22.

The tensioning lever 149, in its turn, is mounted around a lock-housing-side bearing pin 153. It holds a torsion spring 154 which urges the tensioning lever 149 in counterclockwise direction. The shorter lever arm 149" forms the pull-through eye 155 for the core 156 of a Bowden cable 157 which represents a force transmission device 158 leading to the hinged part 102. The other end of the core 156 is fastened on a hinge-lug-side eye 159 of the hinged part 102; see FIG. 21.

The aforementioned tensioning lever 149 and the push lever jointly form a two-part charging lever 160.

Figure 21:
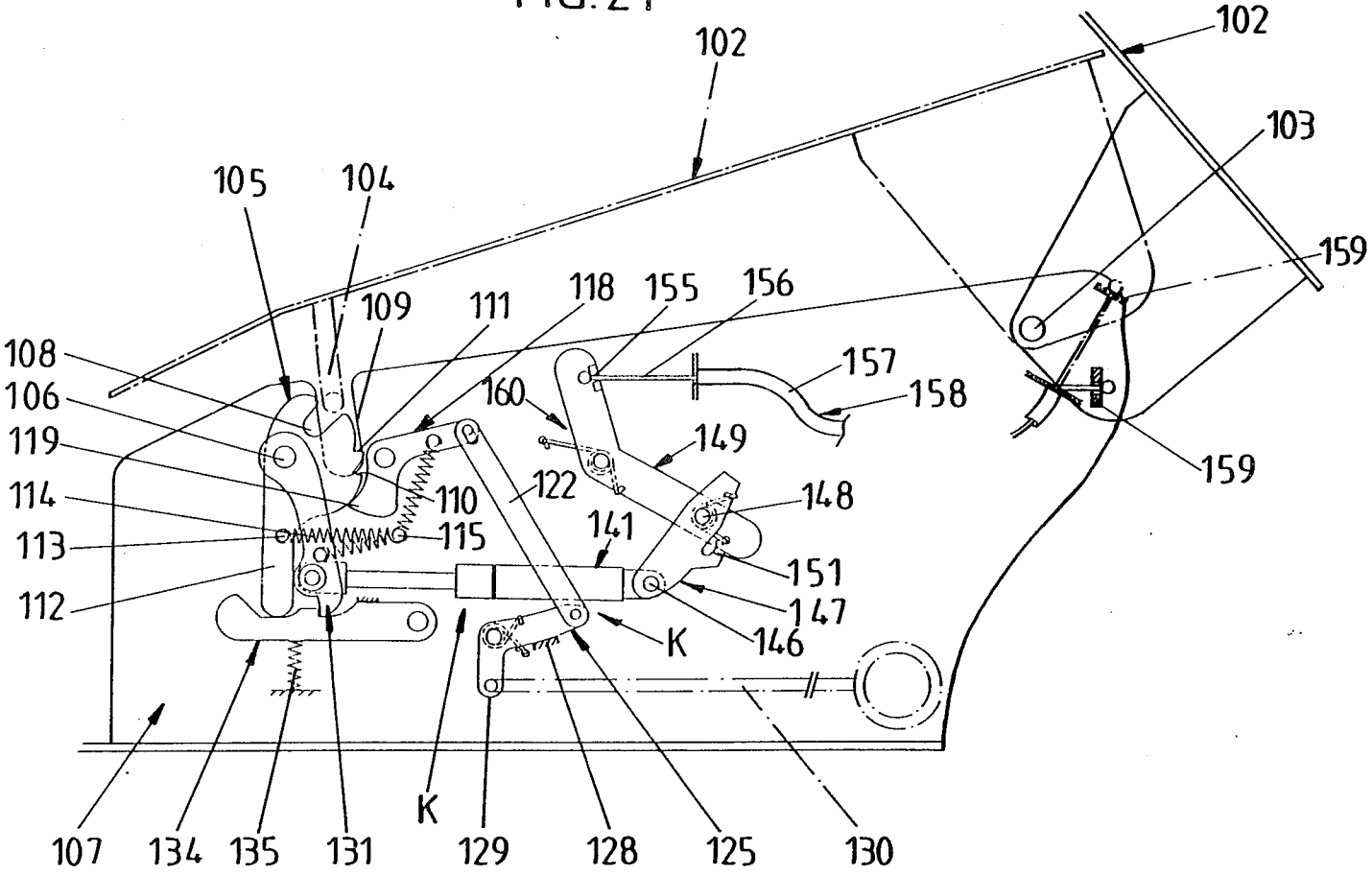
FIG. 21 is a view of the lock according to the sixth embodiment, namely with the hood open and the force accumulator discharged.

The manner of operation of this lock which concerns the sixth embodiment is as follows:

In accordance with FIGS. 21 and 22, the hood 102 assumes its open position. The force accumulator K is in its discharged position. The piston-rod end of the gas pressure spring 141 rests thereby via the locking tooth 132 of the pull lever 131 against the locking shoulder 133 of the release member 134. If the hinged part is now moved, starting from its open position, into the closed position, the eye 159 of the hood 102 swings around the hinge axle 103. Along with this, the tensioning lever 149 is displaced via the core 156 of the Bowden cable 157 and charges the force accumulator via the push lever 147 which assumes the tensioning position, in accordance with the position shown in FIG. 23. Shortly before reaching the closed position of the hinged part, the pivot pin 146 between the force accumulator K and push lever 147 moves over the dead center line T-T which passes through the pivot pin 139 and the transverse pin 148--see FIG. 23--so that the force accumulator is prevented from expanding on both ends. During the further course of the closing movement, the mating closure part 104 extends into the fork mouth 108 of the fork latch 105 and effects a swinging thereof in clockwise direction against the spring load. In this process, the fork latch tail 112 acts on the run-on bevel 137 of the release member 134 which, in this connection, moves away in opposition to spring load in the manner that its locking shoulder 133 comes out of the plane of movement of the locking tooth 132 of the pull lever 131. The force accumulator K can now, via the pull lever 131, swing the fork latch 105 in clockwise direction, the mating closure part 104 being pulled in via the fork mouth 108 while closing the hood, which then enters into a position of sealing contact with a sealing strip (not shown) in known manner. After the piston rod 140 of the gas pressure spring is fully extended, the locking tooth 119 has passed through the pre-detent recess 110 and has extended into the main detent recess 111 of the fork latch and thus blocks the return rotation of the fork latch 105; see FIG. 24.

The push lever 147, in this position, maintains its tensioning position by its stop 151 resting against the facing narrow edge 152 of the tensioning lever 149. Furthermore, in this position the pivot pin 146 is in a position beyond the dead center position.

Figure 25:
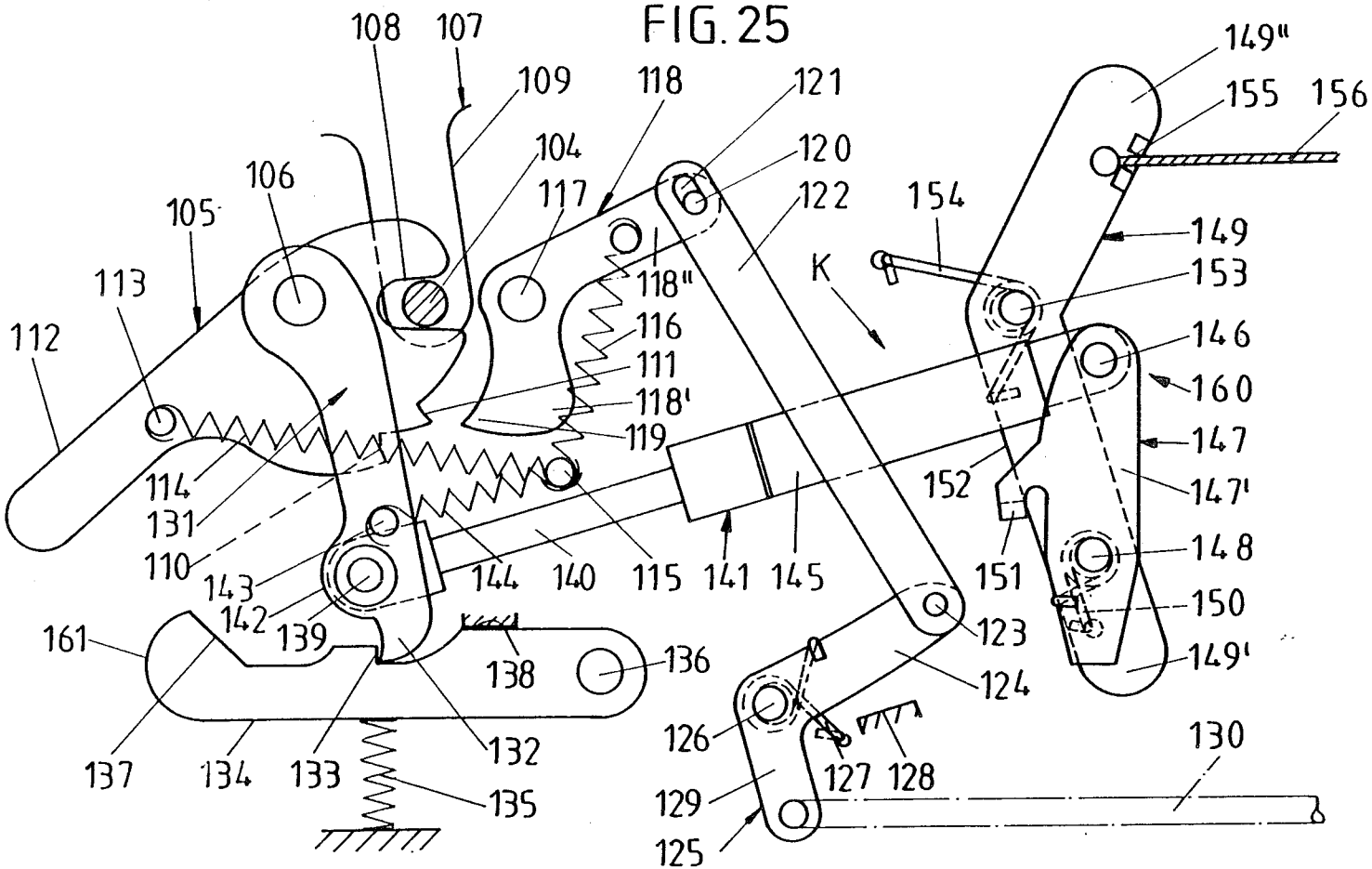
FIG. 25 shows the release position of the closure which is caused by the pull rod.

The opening of the hinged part presupposes actuation of the connecting rod 130. By pulling on it, the position shown in FIG. 25 is reached. In this connection it is so acted upon by the release lever 125 of the push lever 147 that its pivot pin 146 which leads to the force accumulator K has gone beyond the dead center line T-T and come into the other beyond-dead-center position. This release requires only a slight expenditure of force. In this way the force accumulator K is displaced in the direction of the charging lever 160 via the tension spring 144 which acts on the pull lever 131, the push lever 147 being positively swung against its spring action into the position shown in FIG. 25 in which the stop 151 on the other side of the transverse pin 148 rests against the corresponding narrow edge 152. During this return displacement of the pull lever 131, its locking tooth 132 has moved in latch-like manner over the rounded edge 161 in front of the run-on bevel 137 and has then again come in front of the locking shoulder 133 of the spring-loaded release member 134. The hinged part 102 can now be moved into the open position, in which connection the fork latch is swung into its basic position, shown in FIGS. 21 and 22, via the mating closure part 104 and, in addition, by spring load, in which position it lies with its latch tail 112 in front of the run-on bevel 137. During this movement the release member 134 moves away against the spring load in accordance with the dash-dot line showing in FIG. 24. Furthermore, during the opening movement of the hinged part 102, the eye 159 shifts such that the Bowden cable 157 permits the swinging of the tensioning lever 149, in which connection the push lever 147 swings, superimposed, from the position according to FIG. 25 into the tensioned position according to FIGS. 21 and 22. After release of the connecting rod 130, the release lever 125 and the locking pawl also return into their basic position, so that upon a renewed closing of the hinged part, the process described above is repeated.

I claim:

1. In a lock, particularly for a trunk, hatch, engine compartments of automotive vehicles, doors and the like, having a mating closure part adapted to be arranged on a hinged part and to be brought into a closed position by means of an external force, the improvement comprising:

means comprising a force accumulator which forms the external force is charged by displacement of said hinged part;

one end of said force accumulator cooperates with a lock part which grips the mating closure part, the other end of said force accumulator acting upon a swingably mounted charging lever adapted to be released before said force accumulator is charged; said lever is connected by means of a free path to a swing lever articulated to said hinged part, the free path being eliminated when said charging lever is in its release position;

said charging lever has two arms, one of said arms being connected by means of a pin and slot connection, thus forming said free path, to the swing lever, and the other of said arms being connected to one end of said force accumulator.

2. In a lock, particularly for a trunk, hatch, engine compartments of automotive vehicles, doors and the like, having a mating closure part adapted to be arranged on a hinged part and to be brought into a closed position by means of an external force, the improvement comprising:

means comprising a force accumulator which forms the external force is charged by displacement of said hinged part;

one end of said force accumulator cooperates with a lock part which grips the mating closure part, the other end of said force accumulator acting upon a swingably mounted charging lever adapted to be released before said force accumulator is charged; said lever is connected by means of a free path to a swing lever articulated to said hinged part, the free path being eliminated when said charging lever is in its release position;

a manually releasable release device associated with said charging lever;

said release device has a blocking member which blocks the charging lever after the force accumulator has been charged; and said blocking member is connected by means of another free path to a locking pawl associated with said lock part.

3. A lock according to claim 2, wherein said lock part is movable into an unlocked position upon eliminating said another free path between said blocking member and said locking pawl.

4. A lock according to claim 2, wherein the locking pawl having a lock tooth which cooperates with said lock part, said lock part having preliminary and main detent recesses.

5. A lock according to claim 2, wherein said lock part being formed as a swingable fork latch having a fork-latch tail, said force accumulator, operatively acts on said fork-latch tail, the lock further comprising a tension spring for connecting the locking pawl and the fork-latch tail to each other.

6. A lock according to claim 2, wherein said lock part being formed as a swingable fork latch having a fork-latch tail, said force accumulator, operatively acts on said fork-latch tail, and wherein the end of the force accumulator which lies opposite the charging lever is coupled to the free end of a swingable pull lever which cooperates with the fork-latch tail.

7. A lock according to claim 6, wherein said pull lever having a stop which, in order to discharge the force accumulator, is releasable from a locking shoulder of a release member which is releasable by the swinging motion of the fork latch.

8. A lock according to claim 7, wherein said release member being formed as a single-arm rocker which is urged by a spring in the direction of the fork latch and cooperates by means of a run-on bevel with the fork-latch tail and said release member forms a locking shoulder behind which the pull lever engages.

9. In a lock, particularly for a trunk, hatch, engine compartments of automotive vehicles, doors and the like, having a mating closure part adapted to be arranged on a hinged part and to be brought into a closed position by means of an external force, the improvement comprising:

means comprising a force accumulator which forms the external force is charged by displacement of said hinged part;

the force accumulator cooperates at one end with a lock part which catches said mating closure part and at the other end swingably engages a two-part charging lever, the charging lever including a tensioning lever which is swingable around a pin on the lock-housing side and which is acted on by displacement of the hinged part and of a push lever swingably mounted on the tensioning lever and is coupled to the force accumulator; and wherein said push lever for the tensioning of the force accumulator rests in its tensioned position by means of a stop against the tensioning lever.

10. In a lock, particularly for a trunk, hatch, engine compartments of automotive vehicles, doors and the like, having a mating closure part adapted to be arranged on a hinged part and to be brought into a closed position by means of an external force, the improvement comprising:

means comprising a force accumulator which forms the external force is charged by displacement of said hinged part;

the force accumulator cooperates at one end with a lock part which catches said mating closure part and at the other end swingably engages a two-part charging lever, the charging lever including a tensioning lever which is swingable around a pin on the lock-housing side and which is acted on by displacement of the hinged part and of a push lever swingably mounted on the tensioning lever and is coupled to the force accumulator; and a release lever which is displaceable by a pull rod and in release position acts on the push lever so that a pivot point between the push lever and the force accumulator moves into a position past dead center.

11. In a lock, particularly for a trunk, hatch, engine compartments of automotive vehicles, doors and the like, having a mating closure part adapted to be arranged on a hinged part and to be brought into a closed position by means of an external force, the improvement comprising:

means comprising a force accumulator which forms the external force is charged by displacement of said hinged part;

the force accumulator cooperates at one end with a lock part which catches said mating closure part and at the other end swingably engages a charging lever;

said lock part being formed as a swingable fork latch having a fork-latch tail, said force accumulator operatively acts on said fork-latch tail;

said one end of the force accumulator is coupled to the free end of a swingable pull lever which cooperates with the fork-latch tail; and a release member being formed as a single-arm rocker is urged by a spring in the direction of the fork latch and cooperates by means of a run-on bevel with the fork-latch tail, and said release member forms a locking shoulder behind which the pull lever engages.

* * * * *